US005150502A

United States Patent [19]

Roberson

[11] Patent Number: 5,150,502

[45] Date of Patent: Sep. 29, 1992

[54] TEXTILE FIBER LENGTH SORTING APPARATUS AND METHOD

[76] Inventor: James H. Roberson, 10 Ashwood Ave., Greenville, S.C. 29607

[21] Appl. No.: 615,258

[22] Filed: Nov. 19, 1990

Related U.S. Application Data

[63] Continuation-in-part of Ser. No. 339,058, Apr. 14, 1989, Pat. No. 4,970,759.

[51] Int. Cl.[5] ..... D01G 9/08; D01G 15/40

[52] U.S. Cl. ..... 19/105; 19/303

[58] Field of Search ..... 19/65 A, 65 R, 66 CC, 19/105, 205, 240, 303

[56] References Cited

U.S. PATENT DOCUMENTS

| | | | |
|---|---|---|---|
| 3,567,288 | 3/1971 | Wood | 19/65 X |
| 3,709,406 | 1/1973 | Binder | 222/55 |
| 3,815,178 | 6/1974 | Goldman | 19/303 X |
| 4,136,911 | 1/1979 | Husges et al. | 19/105 X |
| 4,219,289 | 8/1980 | Trützschler | 19/105 X |
| 4,394,790 | 7/1983 | Keller et al. | 19/105 |
| 4,403,374 | 9/1983 | Wood | 19/105 |
| 4,657,444 | 4/1987 | Pinto | 19/105 X |
| 4,811,463 | 5/1989 | Leifeld | 19/105 |
| 4,970,759 | 11/1990 | Roberson | 19/105 |

*Primary Examiner*—Werner H. Schroeder
*Assistant Examiner*—Ismael Izaguirre
*Attorney, Agent, or Firm*—Cort Flint

[57] ABSTRACT

A textile apparatus for sorting fibers according to their length. A fiber opening device loosens and separates raw textile fibers transported by an air flow created by an air blower along an air path. A fiber extracting device extracts fibers having an average length greater than or equal to a preselected length from the air flow to produce usable long fibers and creates a separated air flow containing usable short fibers having an average fiber length less than the preselected length for subsequent processing. The long fibers may be compacted into a fiber batt. The usable short fibers may be compacted into a fibrous batt or may be passed through further fiber extracting devices. The apparatus may include a batt former which includes a plenum into which fibers are delivered by the air propeller or blower. The air blower has an adjustable angle of incidence "a" to direct a jet of fiber laden air against a splash plate to cause fibers to be deposited in a fiber compacting chamber in a prescribed cross-directional profile. The apparatus further includes a density sensor which measures the cross-directional density profile of the compacted batt. A controller is responsive to the density sensor and controls the actuator to adjust the angular orientation of the flow directing device to compensate for deviations in the cross-sectional density profile of the compacted batt.

61 Claims, 10 Drawing Sheets

DENSITY PROFILES

TEXTILE FIBER LENGTH SORTING APPARATUS AND METHOD

CROSS REFERENCE TO THE RELATED APPLICATION

This application is a continuation-in-part of application Ser. No. 07/339,058, filed on Apr. 14, 1989, entitled TEXTILE FIBER PROCESSING APPARATUS AND METHOD now U.S. Pat. No. 4,970,759 issued Nov. 20, 1990.

BACKGROUND OF THE INVENTION

1. Field of the Invention

The invention relates to the conditioning and feeding of textile fibers to an associated textile processing machine, and particularly to the pneumatic working of textile fibers inside a batt forming machine and the like.

2. Description of the Related Art

In the past, many devices have been proposed for handling textile fibers in the processes of opening, cleaning, and feeding the fibers.

Fiber is delivered to textile mills in the form of highly compressed and densely packed bales. Within such hard bales the individual fibers are tightly matted, entangled and generally knotted together. Before these fibers can be made into an acceptable textile product, they must be progressively loosened, step-by-step, and ultimately separated to a fiber-to-fiber state. Such separation of the fibers is commonly called "opening" the fibers.

Great care must be exercised in the manner by which the fibers are opened or, otherwise, they can be curled, bruised, broken, or drawn into very tight tiny knots called "neps". Fibers in any of these conditions seriously degrade the quality of the textile product which can be formed. The requirement that the individual fibers must not be degraded during their processing, has posed serious limitations on the techniques available to textile machine designers as to how they can process the fibers from the hard bales down to the individual fiber-to-fiber state.

The well known textile carding machine is often used as the last process to provide the individual fiber-to-fiber separation which is required. The product taken from the doffer cylinder of a carding machine is a very fine web of fibers, which has the visual appearance that one might see if several spider webs were laminated atop each other—hence the name, "carded web". A carded web is extremely delicate and easily damaged because the only forces holding the web together is the natural curliness or crimp of the individual fiber ends which are loosely hooking on to one another. A carded web is not nearly as strong as a spider's web, because the latter has a chemical bonding at every point where the strands cross. For this reason, how one handles a carded web is extremely critical.

The Textile Industry can be broken down into two major groups the non-woven segment and the yarn making segment. In the non-woven segment, the webs of several carding machines are often laminated and the individual fibers bonded together to form the final product. Such bonding may be accomplished by either chemical means (such as latex binders, thermal fusion, etc.), or by physical interlocking of the fibers (such as by needle punching, etc.). To the non-wovens industry, both the cross-direction weight per unit area and the running-direction weight per unit area of the webs delivered by carding machines are extremely critical because such weights govern the quality of their end-product. Furthermore, since web spreading devices are often used immediately downstream of a line of carding machines, to spread the laminated webs even wider, web weight inconsistencies can adversely affect the effectiveness of such spreading devices and the subsequent processing steps.

The yarn making segment of the industry usually gathers the carded web into rope-like form which is called a "sliver". The sliver is generally drawn and spun into a yarn which is formed into a fabric by either knitting or weaving of the yarns. Because the ultimate quality of such fabrics is governed by the uniformity along the lengths of the strands of the yarns used, yarn makers have usually been more concerned with the running-direction weight uniformity of the carded web than they have been with the cross-directional web weight profile. Clearly, to universally meet the particular requirements of both segments of the textile industry, the webs produced by a carding machine need to have good and controlled weight properties in both the running-direction and the cross-direction.

For a given degree of carding quality, there are two principal factors which presently restrict the maximum production rate obtainable from conventional carding machines. First, how well the tiny fiber bundles have been loosened and separated before they are presented to the card's main cylinder. Second, the cross-direction density profile of the very thin sheet of fibers presented to the card's main cylinder. To compensate for the inadequate degree of fiber opening delivered from present day card feeding systems, "high performance" carding machines today often employ either one or two additional licker-in cylinders in series with the single licker-in cylinder which has been traditionally used on conventional carding machines. For reasons discussed below, such additional licker-ins do not provide the results expected or needed. Consequently, such carding machines cannot run at the full production rate potential which can be achieved.

The cross-directional density profile of the sheet of fibers presented to a card's main cylinder is important to high production carding for several reasons. First, if the cross-direction density profile has a uniform state, such as shown by FIG. 5, then the main carding cylinder carries a uniform fiber load across its full width and can run at the optimum or maximum production rate. Unfortunately, the cross-direction density profile of the batt delivered by present day card feeding devices look more like that illustrated by FIG. 4. Consequently, the carding potential across the card's main cylinder is not fully utilized and the production rate is thereby limited. Secondly, the surfaces of licker-in cylinders and main carding cylinders are covered with literally thousands of tiny teeth and both cylinders are run at very high surface speeds. Consequently, windage currents are created where the licker-in cylinder engages with the main carding cylinder to transfer the fibers carried in the teeth of the former cylinder. Such windage currents tend to blow the fibers toward the outside edges of the card at both the point of fiber transfer, and around the "working path" followed by the main cylinder. This results in a condition known as "light selvages", or carded webs which are substantially lighter on their edges than near their center region. At increased production speeds, increased windage currents are also created by the thousands of teeth carried on the surface of the doffing cylinder, which causes the delicate carded web to be blown about more violently after it is taken from the doffer, which causes web breaks.

To eliminate broken webs, modern "high performance" cards are equipped with complicated web gathering devices (such as belts or a plurality of turning wheels) which gathers the web into a sliver before the delicate web can be exposed to the effects of the doffer windage. However, such web shielding mechanisms are not without their own particular set of problems because they tend to accumulate a build-up of waxes or fiber spin finishes which picks at and snags portions of the tender web, which causes "end breaks" due to wrap-ups. Because they do not utilize a sliver, non-woven applications must use the full width web delivered by the card and, thus, cannot be fitted with such web shielding or gathering devices. Consequently, their current maximum rate of production has been limited by these factors. Therefore, the optimum solution for both non-woven and yarn making manufacturers is to provide a simple means to eliminate "light selvages" and, thereby, obviate the need for the problematical web shielding mechanisms which have heretofore been required to operate carding machines at increased production rates.

As mentioned above, the batts produced by present day card feeding devices have non-optimum cross-directional density profiles, such as shown by FIG. 4. This disadvantage comes about because the friction of the side walls of such card feeding devices dissipates a portion of the energy used to form the batts within their batt forming chambers—irrespective of how the packing work is done, whether by static pressure compaction of the tufts, or by vibrating plate compaction of the tufts, or the combination of both methods. Since side-wall friction cannot be eliminated, the solution is to form batts of fibers in such a way that the effects of sidewall friction are negated.

Another problem faced by modern textile mills is their need to exploit the profits available by operating with reduced inventories. New operational concepts, sometimes referred to as "just-in-time and "quick response", permits such profits. However, to practice these operational concepts textile mills must have total flexibility as to how they supply fiber to each card in the mill. Then, each card can be quickly changed from one blend or mix to another, in order to match instantaneous production needs. Present day card feeding systems can offer such flexibility only at great capital cost and complexity in the distribution systems which are available.

It is known in the art that resting air may be drawn in from the room environment and accelerated by a fan to form a conveying airstream—which is passed through a fiber opening machine which is generating large tufts and flinging them into such airstream for transport to a downstream batt forming apparatus—which contains a fiber condensing screen to retain such tufts while exhausting the transport air back into the environment. Such art may be seen, for example, by reference to U.S. Pat. Nos. 4,769,873; 4,689,857; 4,462,140; 4,009,803; 3,851,924; 3,851,925; and 4,682,388.

With such devices, the air is used just once to convey fiber and all the energy contained in every pound of transport air, as it is dumped back into the environment, is consequently wasted. Additionally, before such air (large quantities are needed) is suitable to be returned to the room—where humans breath it—it must be properly filtered. It is well known that the frictional losses associated with passing large quantities of air through dense/efficient filter media, and the resulting economic costs, are enormous.

Furthermore, in order to make a first class end-product, it is widely accepted that the weight variation of every square yard of carded web delivered by a carding machine must not vary more than plus or minus three to five grains from the nominal or mean operating value. As a frame of reference, such a tight weight tolerance is about equal to the weight of three U.S. Postage Stamps, each measuring about $\frac{7}{8}$ inch × 1 inch. It is very difficult to even measure such standards in a normal operating environment, because vibrating floors, the air currents from the room air conditioning system, and even persons breathing near the sensitive scales needed, all affect their weighing accuracy. Since the carded webs from "high performance" cards are spewing forth at the rate of about 2 to 6 linear yards per second, it is obvious that a crude simplistic approach—like, just opening some fibers and blowing them into box—is incapable of meeting modern production standards. To properly address the problems of producing a very high quality carded web, having the desired weight profiles, and doing so with the minimum expenditure of energy, requires considerable attention to every detail of the various processing steps involved along the way.

For the above mentioned reasons, and others which will become apparent below, such art as cited above is unsuitable to meet the objects of the present invention.

It is known in the art (for example, U.S. Pat. No. 4,520,531) that the cross-directional density profile of a batt delivered by a batt former may be altered through the use of a plurality of damper plates, positioned outside of a fiber condensing screen, to vary the amount of air flowing through different portions of the screen and, thereby, guide tufts to the general regions desired. Such art also teaches that a plurality of wedge shaped members may be actuated within an airstream to modulate the airflow passing through various portions of a fiber condensing screen, and/or that a plurality of blocking members may be moved in or out to vary the cross-sectional airflow area in order to direct various portions of the airflow through different zones of such fiber condensing screen. All of the above mentioned movable members, to alter the airflow through various regions of the fiber condensing screen, are operated in response to a plurality of sensors, disposed downstream of the batt forming apparatus, which feeds back control signals to a plurality of actuator means. The theory behind such devices is quite simple, where the air goes, tufts will later go. The art usually over-simplifies the theory and forgets several key scientific facts. First, tufts flung from the tips of the pins, on fast moving opener rolls, possess great momentum in the direction they were travelling at the point of release—usually downward. Secondly, to move a tuft side-ways, relative to the direction of travel, requires the application of a side-ways force and time, and time requires travel distance. Thirdly, the art usually places the distance, between the opener roll and the top of the column of stock in the batt forming chamber, at something between 16 to 24 inches (due to practical ceiling height limitations). Consequently, there is precious little time for a fast travelling tuft to do much side-ways movement. Therefore, such pneumatic prior art devices often fail to measure up to performance expectations. Due to their sheer complexity and for other reasons which will become apparent below, these type systems are unsuitable to meet the objects of the present invention.

It is known in the art (for example, U.S. Pat. No. 3,787,093) that a plurality of fan wheels may be placed inside a batt former to pressurize the column of stock contained within such batt former. The fan wheels draw tufts and fibers from a distribution system and fling them downward into the batt forming region beneath the fan wheels. The prior art teaches that a guide member or members may be slidably mounted or pivotably mounted within the batt former, in order to attempt to control the air currents and/or tufts flowing around therein. Each pound of common textile fibers contains literally millions of tiny fibers—each having a diameter which is much finer than a human hair. For batt formers operating at production rates of 100 to 200 pounds per hour, over a billion fibers flows through such devices in just a short period. Whenever slidable or pivotably mounted plates are inserted within a highly pressurized batt forming device, operating clearances must always be provided between the movable plates and the machine walls. The billions of tiny fibers flowing are constantly "looking" for joints, cracks, crevices in which to become lodged. With such high numbers present, the mathematical probability that a snag point will be found is quite high. Once a single fiber becomes lodged, others aerodynamically spin on it, due to turbulence and swirls, until ropes are formed. The ropes flop around and interfere with the proper distribution of tufts and air currents within such devices. Additionally, when such tightly spun ropes do occasionally break loose, they are very detrimental to the carded quality of the product. These ropes have been known to choke down and even destroy carding machines. It is well known that centrifugal fans are inefficient devices from an energy consumption point of view. Therefore, the required use of two or more such fans within a batt former is particularly wasteful of energy. For these and other reasons which will become apparent below, this prior art has serious operating disadvantages.

It is known in the art (for examples, U.S. Pat. Nos. 3,400,518 and 3,708,210) that fiber condensing screens may be constructed by the parallel alignment of a plurality of flat bars (long side facing the tufts), or T-shaped bars, or L-shaped bars. The bars are disposed so that spacing gaps between each of the bars form a plurality of vertical slots. The slots allow the passage of air into an exhaust chamber, from a fiber condensing chamber, while restraining the tufts deposited within the fiber condensing chamber. It is also known in the art (for example, U.S. Pat. No. 3,482,883) that another type of fiber condensing screen may be constructed by placing a plurality of thin rods parallel to each other, so that air exhaust slots exist in the spacing gaps between each of the thin rods. Such prior art screens have two common characteristics. First, the thickness of the screens (or the depth of the slots) measured away from the tufts contained within the fiber condensing chamber, is quite thin. Secondly, each of the aforementioned air slots results in an abrupt "flow area" enlargement upon entering the air exhaust chamber. Anytime air passing through a slot-like orifice experiences an abrupt "flow area" enlargement, swirls, eddies and turbulence results. Since many of the tiny hair-like fibers also project through the shallow (thin) slots, while the tufts (from which the projecting fibers are attached) are restrained within the condensing chamber, the swirls in the exhaust chamber causes the projected fibers to be aerodynamically spun and twisted together to form highly detrimental neps. This is a serious operating disadvantage.

It is known in the art that a hopper feeder may be used to supply fiber to a carding machine and such art may be seen, for example, by reference to U.S. Pat. Nos. 3,070,847; 3,738,476; 3,548,461; and 3,562,866. With such art, the objective is to provide a fairly uniform cross-direction density profile in the batts they ultimately form. They attempt to accomplish this by rolling and tumbling a ball of stock contained within the hopper, by an upward moving pinned apron, while the pinned apron extracts tufts from the rolling ball which are deposited into a batt forming chute located down stream. Because the aprons of such devices are comprised of slats loaded with pins which are usually spaced apart about one inch (25 mm), the fiber separation potential of the devices is severely limited. Again, a pound of common textile fibers contains at least one million fibers. If a pound is fortunate enough to be engaged by as many as 1,000 pins (unlikely), this means that the smallest tuft produced will itself contain over 1,000 fibers. These large tufts are unsuitable for high production, high quality carding. Additionally, because of side wall friction in the batt forming chamber, hopper feeders produce batts which have a undesirable cross-directional density profile such as that illustrated in FIG. 4. For these and other reasons which will become apparent below, such art is unsuitable to meet the objects of the present invention.

When processing certain types of fibers (for example, cotton which must pass through elaborate cleaning steps before it is suitable for presentation to a carding machine), it is sometimes preferable to supply fiber to a group of cards from a central supply point. Usually a pneumatic transport system is used which deposits fiber into batt forming devices located at each of the various carding machines in a line. In order to attempt to achieve a fairly uniform cross-directional density profile in the batts delivered by the batt formers of such systems, it is known in the art to arrange the cards of a processing line in an "end-to-end" fashion and flow tufts "longitudinally" down a main transport duct, which passes over the cards in their running-direction. This art may be seen, for example, by reference to U.S. Pat. Nos. 3,029,477; 3,300,817; 3,414,330; 3,112,139; 3,326,609; 3,552,800 and RE 27,967. Here the theory is that a long shallow transport duct, that is the full width of the batt formers, will cause the tufts to be distributed evenly across the widths of the various batt formers as the tufts are deposited therein. However, because of the effects of sidewall friction in the batt formers, they produce a batt having the undesirable cross-directional density profile illustrated by FIG. 4. Additionally, the "longitudinal" or "end-to-end" arrangement of carding machines is non-optimum for many yarn making applications. Carding machines are about 3 times as long as they are wide. Consequently, the "work-path" which must be travelled by a card tender or operator, doffing cans of sliver and transporting them to a subsequent process, is much longer than if the line of cards can be arranged "side-by-side". Because of these reasons and others which will become apparent below, such art is not suitable to meet the objects of the present invention.

Arranging a line of cards "side-by-side" and using a "transverse" method of supplying fiber to the various cards by flowing the large tufts from a central supply point "crosswise", with respect to the running-direction of the cards, is preferable in most yarn making applications. This art can be seen, for example, by reference to British Patent 1,113,033 and U.S. Pat. Nos. 3,473,848; 2,964,802; 3,474,501; 4,476,611; 4,136,911; 3,450,439; 3,667,087; 3,145,426; 3,903,570; and 3,896,523.

Because the stock is flowing first in one direction and then must abruptly change direction, this method of supplying fiber to cards is fraught with many special problems and disadvantages.

Classic examples of pneumatically supplied batt forming devices are disclosed in U.S. Pat. Nos. 4,656,694 and 4,779,310; the latter of which is directed to a control device for reducing the weight errors which are often caused by prior art batt formers. Generally, in this type device, fibrous stock, in large tuftular form, is pneumatically conveyed from a central supply point by a large powerful fan. The fan is connected to a main transport duct which may pass over a group of batt formation machines (Prior art FIGS. 10*a* and 10*b*). The combined actions of gravity and the bleeding of a portion of the main transport air out through screens, disposed along the front and rear walls of the upper fiber reserve chute causes some of the tufts to be extracted from the main transport duct and deposited into the upper reserve chute. A high positive static pressure P5 operates atop the column of fibers in the reserve chute and compresses them downward against a feed roll between the reserve chute and a batt formation chamber.

With the flow down the main transport duct (as shown) the momentum of the fast travelling, coarsely opened tufts causes them to be piled against the left sidewall of the reserve chute (Prior art FIG. 10*b*). This causes the cross-directional density profile of the batt "seen" by the feed roll to take on the appearance illustrated in prior art FIG. 10*c*. This density profile is "lighter" on each side because of the sidewall friction existing in the reserve chute, and skewed off-center due to the momentum of the deposited tufts.

The feed roll presents stock to an opener roll which plucks tufts therefrom and, primarily by centrifugal forces, doffs itself of such tufts by flinging them downward into the bottom batt formation chute. There, a high positive static pressure P6 compresses the tufts to form a batt which is fed outward and downward to a conventional carding machine. Static pressure P6 is caused by a fan, which pressurizes a plenum chamber to attempt to cause a fairly uniform velocity sheet of air to exit through an orifice slot located at the bottom of the plenum chamber. The exiting sheet of air flows generally along a guidesheet and down into the bottom chamber. At this point, the airflow is exhausted through front and rear screens and, is returned to the inlet of the fan.

In theory, any deficiency of tufts—to block off the screens in the formation chamber—will be filled by tufts deposited thereon by the sheet of guide air flowing into the bottom chamber—because the airflow should be greatest in the regions of screens having the most "open" area. This reliance on passive control means to adjust the cross-directional density profile is not totally effective. The resulting density profile of the batt leaving the formation chamber takes on the appearance illustrated by prior art FIG. 10*d*. That is, it is still skewed in the direction of flow of tufts in the main transport duct, but is somewhat improved symmetrically over the batt leaving the upper reserve chute. It is still "light" on the edges. The "lighter" edges result, of course, because of the sidewalls friction acting on the fibers in the bottom chamber, and the fact that the cross-directional velocity profile in the sheet of guide air is likewise adversely affected by the sidewall friction of the batt forming machine.

A static pressure, almost equal in value to P6, exists in the region between the opener roll and feed roll. This static pressure tends to resist the downward flow of the fibers in the stock column and must be counteracted by having an even higher positive static pressure P5 in the main transport duct. There is a practical upper limit as to how high static pressure P5 can be raised, because the increased potential energy level can cause severe chokes, or fiber jams, in the main transport duct. This happens whenever any pressure imbalance exists between the batt formation machine shown and the other batt formation machines which are operating in parallel, because they are all connected to the same transport duct. Such feeding systems have a well known propensity to choke because of such pressure balance sensitivity.

Since such feeding systems are usually employed as a group of batt formation machines connected to the same transport duct, the static pressures developed by their respective individual fans tends to work against, or "fight", the main supply fan which is propelling the stock down the main transport duct. This is a serious misuse of energy, and aggravates the pressure balance sensitivity of such feeding systems because there are frequent occasions when one or more of the batt formers in a feed line must be stopped; because of either a routine "end down" (web breakage) or maintenance being performed on one of the carding machines in the line. Furthermore, since there is a practical upper limit imposed on pressure P5 there is, by consequence, corresponding upper limits imposed also on the pressures P6 operating in the various batt formers. This deprives such prior art systems from the opportunity to be able to pack the batts being formed with an optimum higher pressure. Still further, pressure P5 is constantly fluctuating up and down as the various screens of the various reserve chambers become covered or "blocked" with tufts, as stock flow is intermittently started and stopped from the central feeding point, and as the "back-pressure" from the filtration system fluctuates due to "loading" and "stripping" of the filter media. Fluctuations in P5 are immediately reflected in fluctuations in P6, which is working against it, and the results are adverse fluctuations in the densities of the batts leaving the batt formation chutes. It is primarily to compensate for these undesirable pressure fluctuations and interactions, that elaborate control systems such as disclosed in U.S. Pat. No. 4,779,310 have been proposed.

Classic opener rolls in such feed systems are usually constructed using between 4 to 8 pinned bars, disposed linearly across the width of the opener roll. Each pinned bar is populated with pins spaced apart approximately 1 inch (25 mm) along their length. Assuming the maximum of 8 pin bars is used, and a typical opening roll diameter of 10 inches, and a nominal 38 inches working width opening roll, this computes to a maximum "point density" of about 0.2546 points per square inch of working surface on the opening roll. Since the primary doffing mechanism consists of centrifugal forces flinging off the tufts, a higher pin density over the surface of opener roll does not work properly because the size of the tufts becomes so small that the centrifugal forces become less operative. Likewise, the angle of attack of the pins on the pinned bars cannot be too aggressive toward the fibers because of the difficulty in doffing the tufts from the pins. It is noteworthy that in prior art FIG. 10*a*, the sheet of air flowing along the guide plate is placed at a significant distance off the tips of the pins of the opening roll. These factors all limit the degree of fiber-to-fiber separation possible with the prior art.

Thus, the classic prior art suffers from the adverse effects of sidewall friction, the reduced potential for fiber-to-fiber separation, the adverse effects of pressure sensitivity on the reliable operation of the stock distribution system, and a serious static pressure limitation imposed on the value (non-optimum) which may used in the bottom batt formation chamber to compress the tufts therein.

Accordingly, an object of the invention is to provide a textile apparatus and method for increasing the fiber openness and separation during the processing of textile fibers.

Another object of the invention is to provide a textile apparatus and method wherein the cross-direction density profile of fibers across a batt or sheet of fibers is accurately controlled.

Another object of the invention is to provide a textile apparatus and method which provide total flexibility as to the plying of fibers to associated textile machinery and processes.

Another object of the invention is to provide a simple and efficient textile feeding module which may be universally adapted to accept fibers from any type of source of supply.

Another object of the present invention is to provide a batt forming apparatus which is suitable for receiving fibers from either a hopper feeder (permitting individual card-to-card supply flexibility), or alternatively being connected, as one of a group of batt formers, to a common feeding point (so that all may be supplied from the same source), and which may be easily and quickly switched from one supply mode to the other, so that the textile industry can more readily exploit the profit opportunities offered by the "just-in-time" and "quick response" manufacturing concepts.

Another object of the present invention is to provide a batt forming apparatus which may utilize a very high static pressure in its batt forming compaction operation but which does not interfere with the flow of stock into the batt forming apparatus, irrespective of the mode of supply.

Still another object of the present invention is to provide a textile apparatus and method by which fibrous tufts may be highly opened, or separated to an almost fiber-to-fiber state, by an opening roll, which may contain on its surface a very large number of teeth per unit area and such teeth may be positioned to present a high angle of attack toward the fibers.

Another object is to provide an efficient means to doff the fibers impaled on the teeth of such an opening roll.

Yet another object of the invention is to provide a fluidized mixture, of highly opened fiber bundles and transport air which causes the fiber to be deposited into a batt forming chamber in such a way that, after being acted upon by a high positive static pressure, a batt having a very high running-direction evenness and a desired cross-directional density profile results.

Another object of the invention is to provide a means of separating the conveying air from the highly opened fibers in such a way that a portion of such air may be advantageously used to efficiently doff an opening roll.

Another object of the invention is to provide an improved carding machine which may be operated at very high production rates without the need for additional licker-in cylinders which have heretofore been necessary in order to achieve a comparable high rate of production.

Another object of the present invention is to provide a means to custom tailor the cross-directional density profile of the batt fed into a carding machine such that the web delivered by the carding machine need not suffer from lighter selvages than the weight of the web near the center of the carding machine so that it can operate at higher speeds without adverse windage effects, and the need for the addition of complex web shielding or collection devices.

Another object of the present invention is to provide an improved carding machine which is universally suited for making either a non-woven web or a sliver, because such card includes a device which custom tailors, in a desired manner, the weight per unit area of the web leaving the carding machine and obviates the need for web gathering devices.

Another object of the present invention is to provide a batt forming apparatus which obviates the need for either complicated external screen damper plates or problematical internal steering plates which have heretofore been necessary in order to vary the cross-directional batt density profile.

Another object of the invention is to provide a means of separating the conveying air from the highly opened fibers in such a way that a portion of such air may be advantageously directed to supercharge the boundary regions near the sidewalls of the batt forming apparatus, so that the velocity profile of the doffing air knife may be optimized and thereby it requires a minimum amount of operating energy.

SUMMARY OF THE INVENTION

The above objectives are accomplished according to the present invention of a batt former having an air circulation loop in which air is recirculated. A fan blower distributes fiber-laden air in a plenum in the loop using an adjustable jet to deposit fibers in a fiber compacting chamber in accordance with a desired cross-directional profile. An air separator at the fiber compacting chamber separates the air flow between front and back air flows to deposit the fibers and create a supercharged air flow below the air separator having increased energy at its side regions. The supercharged air flow is accelerated through a channel and forms an air knife which doffs an opening roll. The opening roll, having been supplied fibers from a fiber supply module, opens the fibers. The supercharged air flows create a velocity profile across an air knife which efficiently doffs fibers across a working width of the opening roll to create the fiber-laden air flow. Advantageously, the fibers are deposited in the fiber compacting means so that the fibers at side walls of the plenum may have increased residence time which compensates for side wall friction. The air circulation loop and fan blower provide a unique static pressure situation in the batt former which allows alternate type fiber supply modules to be attached to an inlet of the fiber opening rolls and enhanced fiber compaction in the batt forming chambers. This is because the static pressure at the supply inlet and at the channel area in which fibers are doffed from the opening roll is nearly equal or less than ambient and does not interfere with the injection of stock at the supply inlet. Further, air, fiber, and other hazardous impurities are prevented from being blown into the room through the opening roll area. The batt former is advantageously combined with a carding machine to feed a compacted fiber batt into the carding machine having such a cross-directional density profile that light edges are eliminated on the carded web produced by the carding machine. By using an opening roll in the batt former having teeth of wire or pins of high density per square inch, increased opening and cleaning of the fibers is possible so that a carded web can be produced more efficiently and at higher speeds.

The present invention is concerned with substantially improving the processes of forming batts and carding textile fibers by permitting conventional carding machines to be utilized and run at superior production rates than heretofore possible, but without their need for additional complex and troublesome machine elements. It is also concerned with producing carded webs which have improved weight properties, both running-direction and cross-direction. It is further concerned with providing a carding machine the capability of being supplied fibrous stock simultaneously from a variety of up-stream processes, depending upon the instantaneous production needs at hand, in order to maximize process flexibility and profitability.

BRIEF DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

A construction designed to carry out the invention will hereinafter be described, together with other features thereof.

Figure 1:
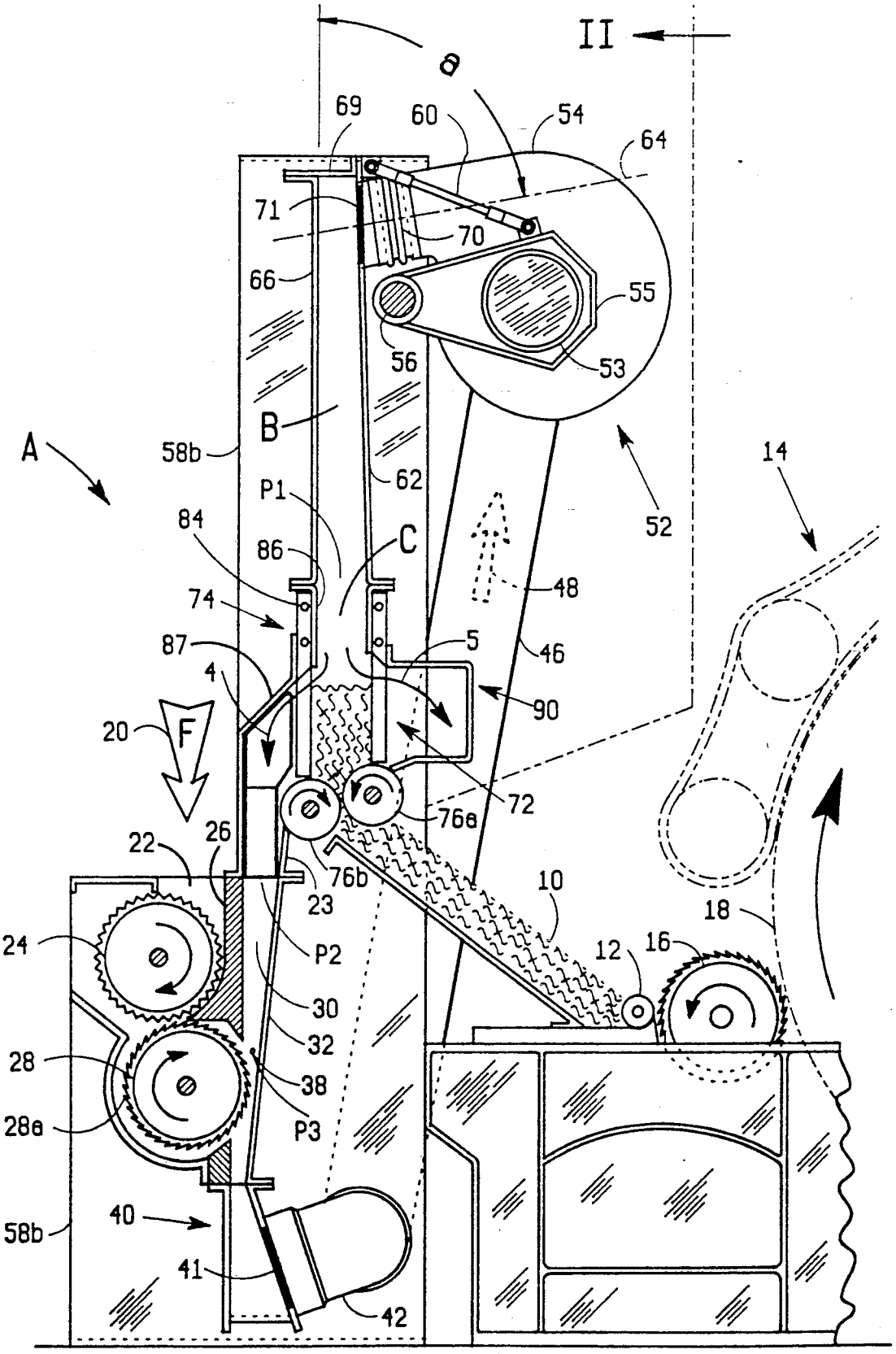
FIG. 1 is a schematic sectional side elevation view, which would appear if the near sidewall 58*a* were removed from the batt former A along the Section Line indicated by Arrows I—I, as shown on FIG. 2.

Referring to FIG. 1, there is shown a batt former, designated generally at A, feeding out a precisely formed batt 10 of fibers to a card feed roll 12 of a carding machine, designated at 14. As a conventional carding machine, it would also utilize at least one licker-in cylinder 16 and at least one main carding cylinder 18, as is well known in the art. As described below, fiber F may be supplied to batt former A in any of several different ways. Fibers enter, in the general location and direction of arrow 20, through an inlet opening 22 (disposed across the width of the machine) and are fed by a primary feed roll 24, which acting in cooperation with a feed plate 26 to form a very tight nip, presents the infed fibers to a fiber opening means which includes an opening roll 28.

Those skilled in the art will recognize that the short nip length provided by the feed roll 24 feed plate 26 combination can be lengthened by substituting a pair of cooperating nipping feed rolls (like, for example, 76*a* and 76*b*) to restrain the fibers fed against the shredding action of opening roll 28, and passing the infed batt through the nip of the roll set. In this case, it may be desirable to modify the "nose" of feed plate 26 in a conventional manner. It is advantageous to be able to practice the present invention with such a modification, because there are instances where one may want to run "long" fibers (say, 3 inches or greater) and short nip lengths can causes such fibers to be damaged. However, with most common lengths of fibers, the feed roll / feed plate combination provides the preferred nip length.

It has been found that the present invention yields the best results when the fibrous mass being processed is reduced to extremely small fiber bundles, e.g. almost the same size fiber bundles as carried on the licker-in cylinders of conventional carding machines. To accomplish this very high degree of fiber separation, the present invention contemplates using a very high number of teeth per unit area disposed around the circumferential working surface of opening roll 28. It is also contemplated to position the teeth 28*a* on opening roll 28 such that they may have a high angle of attack toward the fibers at the nip point. For example, the invention may be practiced using an actual card licker-in cylinder as opening roll 28. Such cylinders are usually clothed with saw teeth wire having a point density of about 20 to 40 points per square inch of working surface—which is about 100 to 400 times the point density of classic opener rolls described above. In the present invention, the term "teeth" means wire or pins. It has been found, according to the present invention, that a range of about 1 to 40 teeth per square inch may be utilized to provide superior opening yet be efficiently doffed.

One of the problems of using such a high tooth density, is the difficulty of doffing the fine web of fibers off of all the teeth. As the teeth 28*a* of opening roll 28 shreds and combs the fibers away for the nip point, the teeth travel in an arcular path with respect to the nip point and this drags the strung-out fibers deeply down into the teeth on the roll. Consequently, the forces of fiber / tooth entanglement exceeds the centrifugal force available to fling the tiny fiber bundles off the opening roll 28, because they have such a low mass when opened to such a high degree. Rolls having a very high tooth density have a well known propensity to "wrap-up" and choke the machine down. This is why the classic opening roll, employed in prior art batt formers, has been provided with only a few rows of coarsely pinned pin bars disposed around their circumference. This doffing problem, in conventional carding machines, is solved by using an even higher tooth density on the main carding cylinder and operating it at a higher surface speed than the licker-in cylinder, so that the fibers can be literally stripped out of the teeth of the latter by a mechanical action.

In batt former A, channel means includes a converging acceleration channel 30 formed by a surface of feed plate 26, a surface of a plate 32 and two side plates 58*a* and 58*b*. Acceleration channel 30 is used to accelerate the recirculating airstream to a very high velocity, so that it can be used as an air knife to cut the web of fibers out of teeth 28*a* of opening roll 28. The doffing action begins at a line 38, which runs across the width of batt former A, at which line it is desired that the velocity of the air knife be at least equal to the surface speed of the teeth on opening roll 28. The doffed web, entrained in the air knife, becomes a fluidized mixture which flows downward into a transition piece, shown generally at 40.

Figure 2:
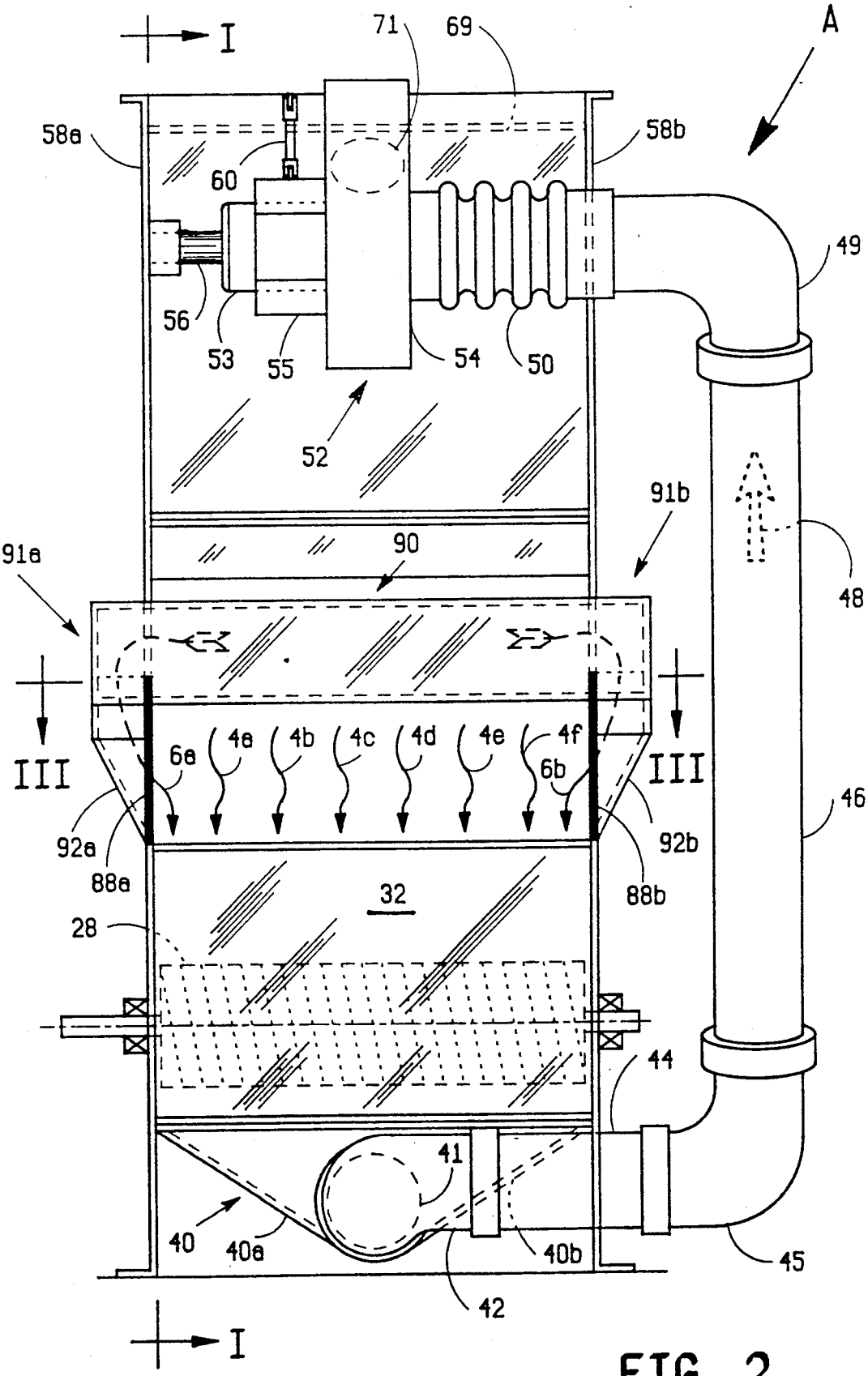
FIG. 2 represents a schematic frontal elevation view of the batt former A, taken from the carding machine 14, in the direction indicated by Section Line Arrows II—II. For the purpose of clarity, the fibrous batt 10, the two batt feed rolls 76*a* and 76*b*, and forward seal plate 23 have been omitted from FIG. 2.

As can best be seen in FIG. 2, duct means includes a transition piece 40 comprised of two downward converging side plates 40*a* and 40*b* which guides the fluidized mixture generally toward the bottom center of batt former A, where it exits through an outlet hole 41 and enters a first turning elbow 42. The flow continues through a connector pipe 44, a second turning elbow 45, and into riser pipe 46 which directs the flow in a generally upward direction, as indicated by arrow 48. Next, the flow passes through a third elbow 49, through a flexible connector 50 (for example, an accordion rubber hose), and into an air propelling means in the form of a centrifugal blower or fan, shown generally at 52.

The fan wheel (not shown) is affixed to a protruding shaft (not shown) of an electric motor 53, which along with the fan casing 54, is attached to a frame 55 which is pivotably mounted on an axle bar 56. Bar 56 is connected to the frame of batt former A in order to support the complete fan assembly, and may be suspended at both ends from side walls 58*a* and 58*b*, respectively.

As can best be seen in FIG. 1, flow directing means is provided by a clevis mounted turnbuckle 60 connected between pivotably mounted fan support frame 55 and a front splash plate 62, which is fixed with respect to the frame of batt former A. Thus, by turning the turnbuckle, the angle of incidence "a", between the axis of the fan's exit (line) 64 and back splash plate 66, may be readily adjusted to any desired operating value. A plenum means is provided by a spray chamber B defined by surfaces of top plate 69, front splash plate 62, back splash plate 66, and side plates 58*a* and 58*b*. The spray chamber is provided to receive the very high velocity jet of conveying air and finely opened fibers being flung from fan 52. This jet passes through a second flexible connector 70, through an inlet hole 71 (shown darkened in FIG. 1 and dotted in FIG. 2) which is cut in front splash plate 62. A batt forming chamber C, located below spray chamber B, includes front and back screen assemblies, shown generally at 72 and 74 respectively, side plates 58*a* and 58*b* and batt feed rolls 76*a* and 76*b*. These rolls deliver compacted batt 10 to card feed roll 12. Fiber compacting means for compacting fibers to form the batt includes static pressure P1 acting on the top of the fiber column in batt formation chamber C. Front (first) and back (second) screen assemblies 72, 74 define air separation means for separating the fibers from the air flow transporting them. The air separates through the screens to deposit the fibers into the fiber compacting chamber C.

As the fluidized mixture jet strikes back splash plate 66, there is a violent collision and the momentum of the fibers causes them to spray about in all directions at once. Many of the fibers ricochet almost instantly down into, and across the full width of, batt forming chamber C. Another portion of the fibers seem momentarily "stunned" by the impacts with the various walls and appear to float for brief instants in the turbulent eddies existing within spray chamber B. However, in the next instant, they may be driven violently downward toward any "un-blocked" area which may occur momentarily at either of the screens. The actions occurring within spray chamber B can best be described as, simply, organized chaos. However, the process is surprisingly self-levelling and self-correcting.

It appears that by piling, or washing, fibers slightly higher up side plates 58*a* and 58*b* than the elevation of the fiber column existing near the center portion of batt forming chamber C by using the flow directing means, the sidewall fibers have a longer "residence time" within the batt forming chamber. Since all the fibers within the batt forming chamber are acted upon by the same high static pressure P1, the increased packing work caused by the higher "residence time" tends to compensate for the undesired effects of the sidewall friction on the batt formed.

Figure 4:
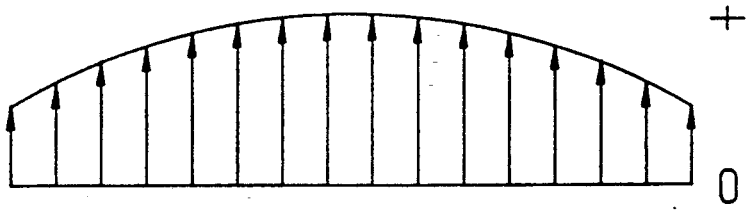

With the present invention it has been found that if the angle of incidence "a" is set at approximately 90 degrees, then the cross-direction density profile appearing in formed batt 10 takes the form illustrated by FIG. 4. A domed profile is produced which is heavy in the center and light at the edges. As mentioned supra, such a density profile is typically characteristic of most prior devices.

Figure 5:
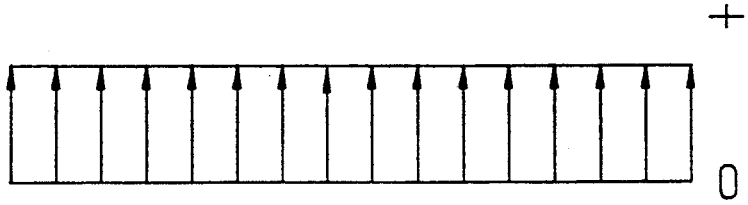

It has been further found that if the angle of incidence "a" is set in the approximate region of 50 to 80 degrees, then the cross-direction density profile of formed batt 30 can be made to take on the form illustrated by FIG. 5. An essentially constant density across the full width of the batt is produced.

Figure 6:
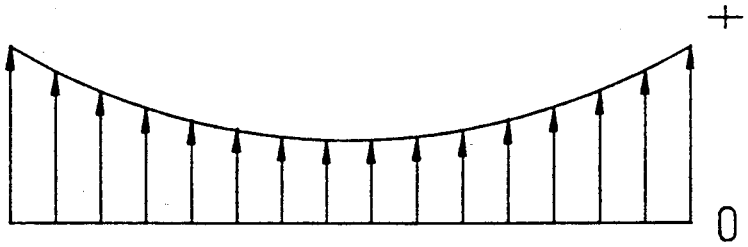
FIGS. 4, 5, and 6 are schematic representations of either various density profiles which may exist across the width of a fibrous batt, or various airstream velocity profiles which may exist across the width of an air channel.

Further, if the angle of incidence "a" is set in the approximate region of less that 50 degrees, then the cross-direction density profile of formed batt 10 can be made to take on the form illustrated by FIG. 6. A dished shape which is light toward the center and heavy at the edges is produced.

Thus, by merely changing the angle of incidence "a" it is possible to easily custom tailor the cross-direction density profile, as desired, to meet the special needs of the carding machine and/or the needs of any subsequent process which follows the carding machine, e.g. a web spreader for making a non-woven product. Clearly, this simple mechanism overcomes many of the disadvantages suffered by prior art.

Referring again to FIG. 1, if back splash plate 66 were hingably mounted at its lower edge (or broken into two parts, with a bottom first part rigidly fixed to the side walls 58*a* and 58*b* and a top second part hingably mounted atop the first), then fan 52 could be fixed. The angle of incidence "a" of the jet of fluidized mixture could then be varied by tilting the modified splash plate toward or away from the axis (line) 64 of the jet. One may alter the angle of incidence either way as well as others which become apparent after having been taught the advantages of the present invention. A pivoted fan 52 has been shown as the preferred embodiment because of the advantages of more easily sealing the system with respect to the room or ambient pressure. It should be borne in mind that the present invention contemplates being able to use a much higher stock packing pressure (static pressure p1), than is practical in the classic prior art. This enhances the uniformity of the density, both running-direction and cross-direction, of the batt which is formed. Consequently, sealing integrity is quite important.

Likewise, those skilled in the art will readily appreciate that the air knife capability to doff a finely toothed opener roll will also doff a coarsely toothed roll, of the type used in the prior art, because the latter has additional centrifugal forces to aid in the doffing action. This ability to operate batt former A with either type roll is advantageous as there are some types of fibers which can be "over-worked" by the intense opening capabilities provided in batt former A. However, with most common types of fiber, intense opening is preferred.

Preferably acceleration channel 30 should be oriented such that a very substantial portion of the highly organized airflow of the air knife jet passes through the teeth 28*a* (or pins) carried on the surface of opening roll 28, in order to enhance the doffing action.

Figure 7:
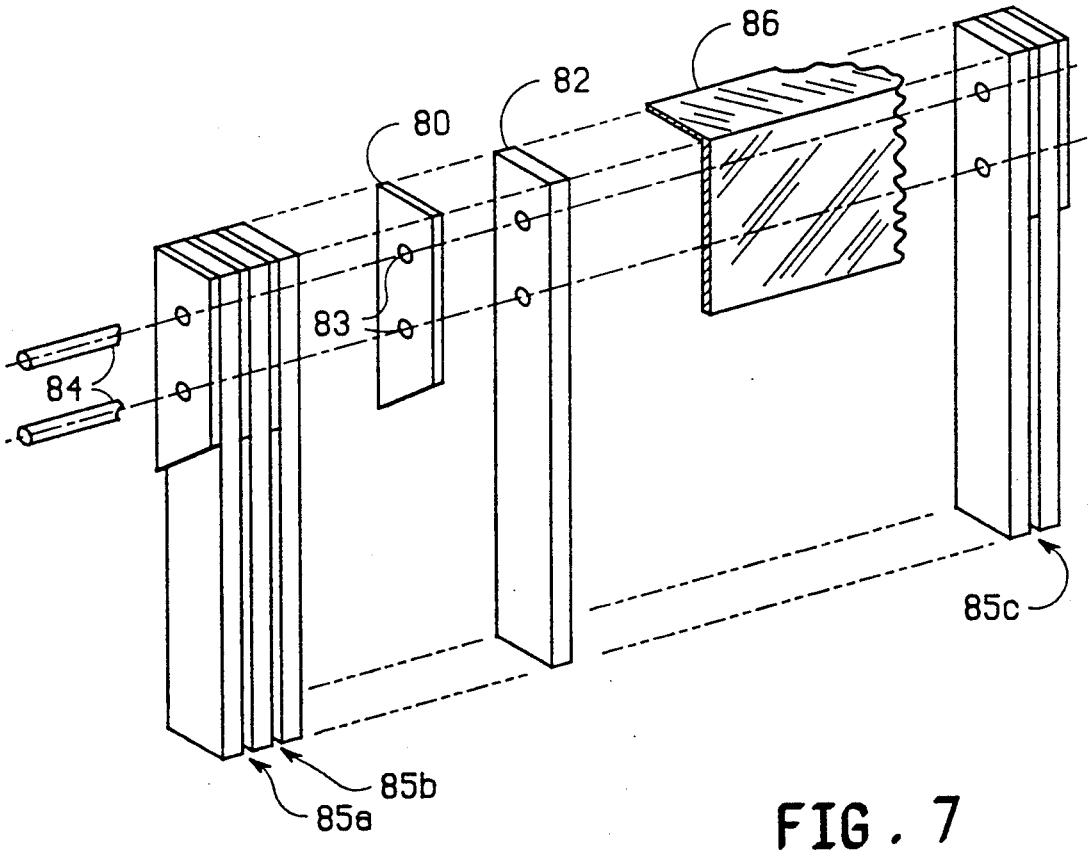
FIG. 7 is a schematical pictorial representation showing the construction of the back screen assembly 74, as would be seen from inside batt forming chamber C.

FIG. 7 is an exploded pictorial representation of a preferred embodiment of the construction of screen assemblies 72 and 74. FIG. 7 represents a view of back screen assembly 72, as would be seen from within batt forming chamber C. A plurality of thin short spacer bars, such as 80, are alternately laminated, or sandwiched, with a plurality of longer finger bars, such as 82. All bars are provided with two holes 83 which are spaced an equal distance apart and two dowel rods 84, which provide alignment and structural support, are passed through alignment holes 83. A sufficient number of spacer bars and finger bars are selected so that the resulting laminated structure spans the width between the inside surfaces of side plates 58*a* and 58*b* (the inside working width of batt former A). With this construction, a plurality of narrow air slots, such as 85*a*, 85*b*, . . . 85*c* exist between adjacent finger bars. Naturally, the width of each air slot, or passage, is determined by the thickness of the spacer bars used.

An L-shaped wrapper plate 86, having a length equal to the inside width of batt former A, is fastened to the laminated screen assembly. Wrapper plate 86 serves as a shield to prevent the tiny fibers from becoming lodged within the numerous joints existing between the various laminations. The flowing fibers merely "see" a very smooth surface.

Screens constructed according to FIG. 7 provide a relatively thick deep wall through which the air slot passages form long shallow flow paths. These keep the air currents flowing in an organized manner and this greatly reduces the turbulence and swirls which can spin fibers to form detrimental neps. Such construction offers significant advantages over the thin shallow perforated walls proposed by the prior art. Thick wall fiber condensing screens are particularly well suited for use with fibers in the highly liberated state contemplated by the present invention, because with a much higher number of individual fibers flowing freely about there is a much higher probability that some of their loose ends will either project into, or be drawn into, the exhausting air passages. With the much larger tufts used in prior art devices, most of the fiber ends are tied-up within each of the globs of fiber and only those fuzzing off from the surfaces of the globs are subject to projection into the exhausting air passages. Not only are thick wall screens better suited for handling highly liberated individual fibers, but they are also better suited for handling the globbier stock characteristic of prior art batt formers as well.

Construction of the front screen assembly 72 can take the same format as just described for the back screen assembly 74. However, with the present invention it is contemplated to either use spacer bars having a shorter length for the front screen than those used for the back screen, or to raise the elevation of the front screen relative to the back screen, so that the size of the "unblocked" air slots of the front screen is greater than the "un-blocked" air slots of the back screen (study FIG. 1 carefully). The taller "open" air slots, above the height of the stock column in the batt forming chamber at the front screen provides a means for creating a lower static pressure drop across the front screen. Because the air exhausted through the front screen must follow a longer and more circuitous path before reaching the acceleration channel 30, than the air exhausted through the back screen, it is highly desirable to have a lower pressure drop through the front screen. This ensures that sufficient energy is available to achieve the desired distribution of flows throughout the batt former A. By judicious selection of simple geometries, one can achieve the desired proportions of airflow through the two screen assemblies, by regulating the pressure drop occurring across each. The significance of this will become more apparent momentarily.

Figure 3:
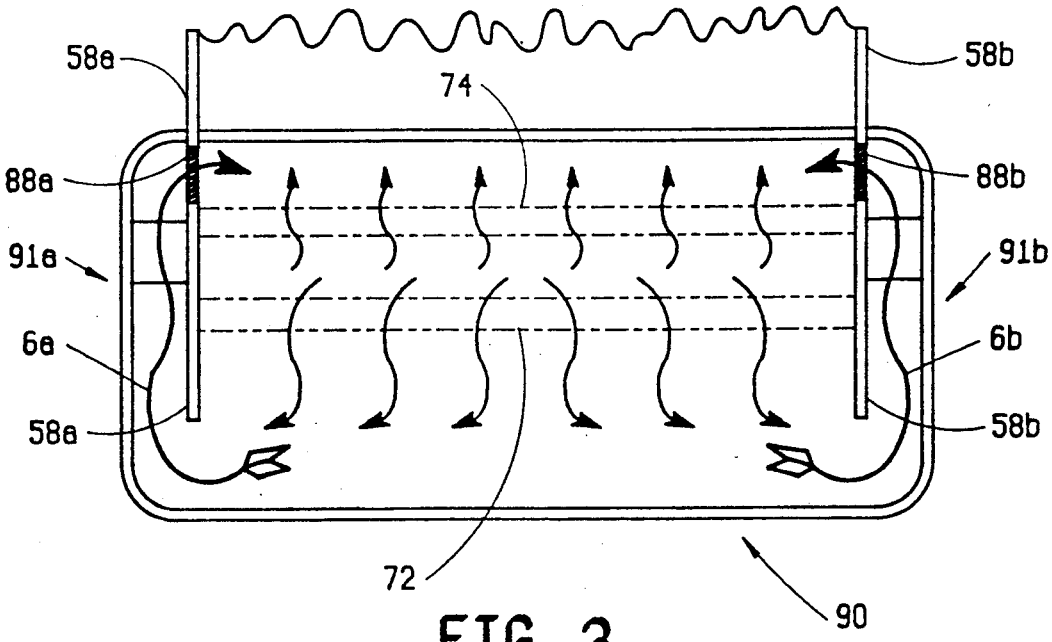
FIG. 3 is a schematic sectional plan view taken in the direction indicated by Section Line Arrows III—III, as shown on FIG. 2.

Means for distributing the front and back air flows to form a combined air flow with supercharged side regions will now be described. As can best be seen in FIG. 1, a portion of the conveying air, comprising part of the fluidized mixture, is exhausted through back screen assembly 74 along the path indicated by arrow 4. The channel means includes a dog-leg shaped turning plate 87 which turns the flow downward, across the full inside working width of batt former A, along a path indicated by arrows 4*a* through 4*f* (FIGS. 2 and 3) whereupon this airflow enters the inlet of acceleration channel 30. The remaining conveying air is passed through the front screen assembly 72 along the path indicated by arrow 5 (FIG. 1) and enters a front cross-flow channel indicated generally at 90 which forms part of the channel means between the air separation screens and fiber opening roll. As can best be seen in FIGS. 2 and 3, the air flowing into cross-flow channel 90 divides (as traced by arrows 6*a* and 6*b*) and flows through two side-flow channels, indicated generally at 91*a* and 91*b*, toward the rear of batt former A. After passing the vertical plane of back screen assembly 74, these two flows are turned inward and downward by deflector plates 92*a* and 92*b* which causes these flows to pass through two inlet ports 88*a* and 88*b* which are provided in side plates 58*a* and 58*b*, and then into the inlet of acceleration channel 30. In this manner, means for supercharging the energy level of the air entering the inlet of acceleration channel 30 is provided so that the air is "supercharged" in the regions of side plates 58*a* and 58*b*, which overcomes their sidewall friction effects. Otherwise, the cross-directional velocity profile of the air knife exiting the acceleration channel would be adversely affected. This air knife is used to "cut" or strip the finely opened fibers from the teeth of opening roll 28. In lieu of using 2 screens, a single screen may be used with air exit passages dimensioned at the sides to "supercharge" the side air flows.

It has been found that if little or no air is allowed to pass through the front screen assembly 72 to supercharge the sidewall regions then the resulting cross-direction velocity profile of the air knife takes on the appearance shown in FIG. 4. There is a high velocity near the center and lower nearer side walls 58*a* and 58*b*, which is the classical velocity profile of a single, two-dimensional flow channel. (It being understood that the profiles represented in FIGS. 4, 5, and 6 illustrate magnitudes only, and that the direction of the air knife is, of course, downward.) The critical velocity needed to doff opening roll 28 is represented by the minimum velocity appearing in the air knife profile. A profile such as FIG. 4 means that the only way to increase the velocity at the sidewalls, up to the required critical doffing value, is to increase the overall or total flow rate volume. This, imposes a non-optimum energy burden on fan 52 which must supply the energy dissipated by the frictional losses throughout the system, which are governed by the total volume of flow required. It has been further found that if a desired volume of flow is allowed to pass through the front screen assembly, to supercharge the regions near side walls 58*a* and 58*b*, then an air knife velocity profile such as shown by FIG. 5 results. This is an optimum running condition, because it represents a maximum doffing velocity using a minimum total air flow volume hence minimum energy losses. If an excessive amount of air is allowed to pass through the front screen, relative to the back screen, then the side wall regions can become over-supercharged resulting in a non-optimum air knife velocity profile, such as shown by FIG. 6.

With the present invention it has been found that a very good distribution of flows can be obtained by placing the elevation of the top of the air slots of the front screen assembly 72 approximately one inch (25 mm) higher than the top of the air slots of the back screen assembly 74. This assumes a nominal 38 inches (965 mm) working width batt former A. This provides the desired difference in pressure drops between the two screens. Those skilled in the art will recognize that the same effect can be obtained by placing the tops of the air slots of both screens at the same elevation, while using slightly wider spacer bars 80 to construct the front screen so that it has a lower pressure drop than the back screen. The purpose of a fan, such as 52, is to add energy to an air stream, and for a given inlet and exit velocity (constant kinetic energy level) the energy added takes the form of potential energy which is manifest as a rise in static pressure. Decelerating a flow within a channel causes an increase in static pressure, as the decreasing kinetic energy is converted to increasing potential energy. Conversely, a static pressure drop occurs whenever a flow is accelerated. However, frictional losses cause a drop in static pressure without a corresponding beneficial rise in velocity. With these known facts in mind, several key advantages of the present invention can become apparent over the prior art.

First, the cross-sectional flow area at the inlet of batt forming chamber C is the largest flow area anywhere throughout the system. Hence, the velocity is relatively low. This coupled with the fact that fan 52 is immediately upstream means that the static pressure P1 can be raised to a very high positive pressure, with respect to the room or ambient pressure. A very high positive pressure P1 permits very intense, enhanced packing of the fibers in the batt forming chamber C. This results in a more even density in formed batt 10 in the running-direction and the cross-direction, custom profiled as described above. Secondly, static pressure P2 is dropped to P3 due to the flow acceleration through converging acceleration channel 30. Also P3 is on the "suction" side of fan 52. Consequently, by selecting the appropriate geometry for plate 32, the static pressure in the region of opening roll 28 can be set to be either neutral, or slightly negative, with respect to the room or ambient pressure. This feature of the present invention is very advantageous. It prevents hazardous dust and fiber from being blown into either the room or the bearings of opening roll 28. Further, it prevents an adverse pressure situation from developing at fiber inlet opening 22. The importance of this latter point will become more apparent momentarily.

If desired, the static pressure in the region of opening roll 28 can be made even more negative by simply swapping the positions of turning elbow 45 and fan 52 (FIG. 2). In this instance, some form of bracket would be needed to fasten elbow 45 to a pivoted support, like frame 55.

Figure 8:
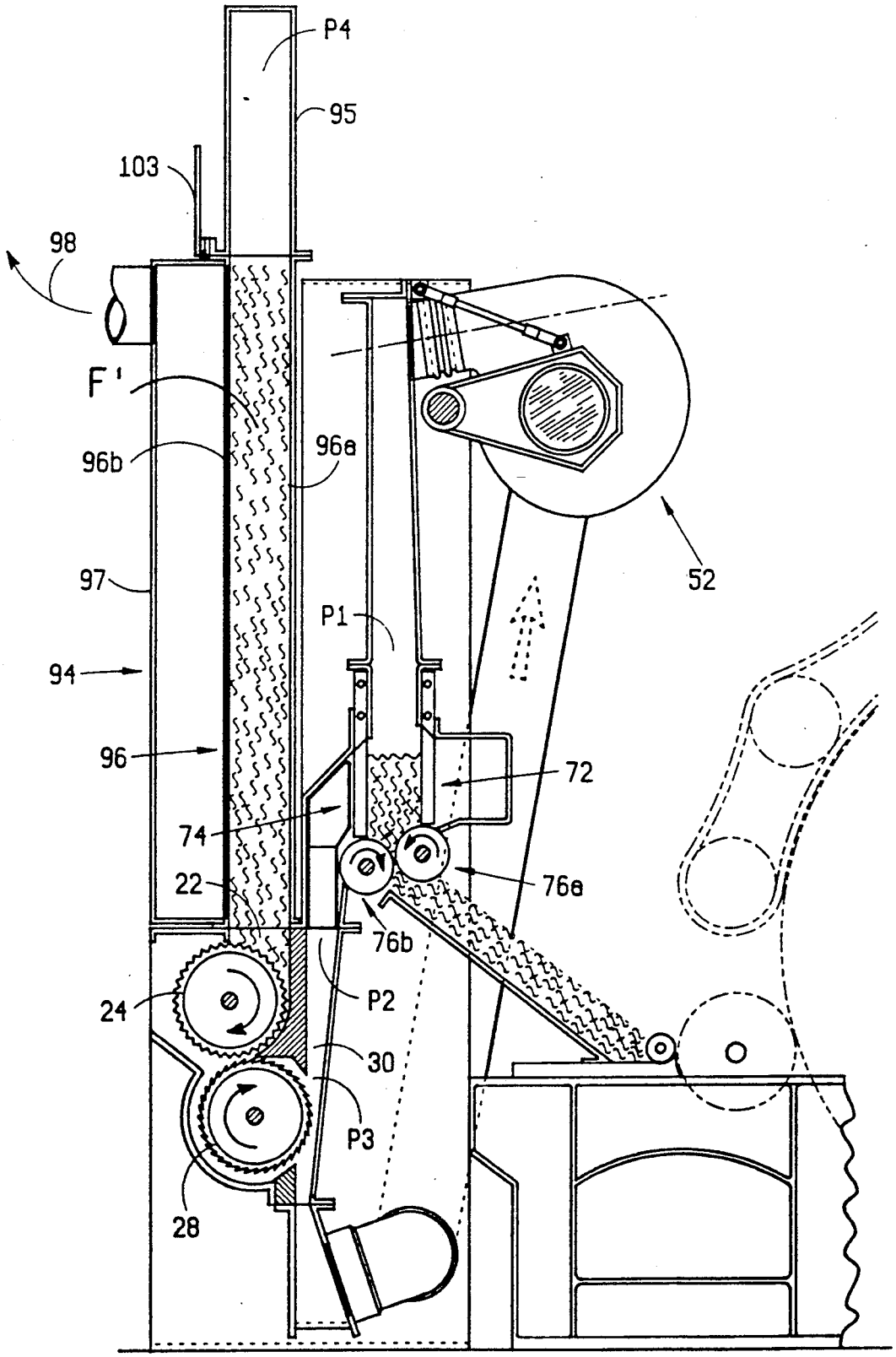
FIG. 8 is a schematic sectional side elevation view showing how a pneumatic transport means may be used to supply fibers to the present invention.

As can best be seen in FIG. 8 there is a fiber transfer assembly, shown generally at 94, connecting inlet opening 22 of batt former A to a main transport duct 95 which is supplying fiber from a central feeding point. A reserve chute 96, comprised of a front wall 96*a* and a perforated wall 96*b* contains a column of fibers F' which are fed through inlet opening 22 and thence to feed roll 24. The combined actions of gravity and the bleeding of a portion of the conveying air flowing down main transport duct 95 deposits tufts onto the stock column in the reserve chute. The air bled from transport duct 95 passes through perforated wall 96*b* and is collected within a capture hood 97 from which such air is ducted away to a filtration system as shown generally at 98. Static pressure P4 acts on the top of the stock column F' and compresses it downward through inlet opening 22, in a manner which is well known.

As mentioned above, the pressure condition at inlet opening 22 is either the same as the room air pressure or slightly negative with respect to it. As a consequence, static pressure P4 can be much lower than is needed by classic prior art systems. Hence, the energy burden imposed on the main transport fan is reduced. Furthermore, with a lower value needed for P4, there is less tendency for the main transport duct 95 to choke. This represents a significant improvement over the classic prior art.

Figure 10C:
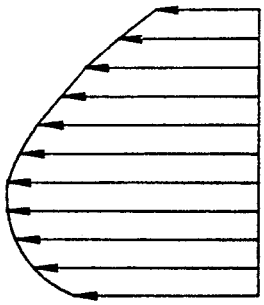
FIGS. 10*a* through 10*d* are schematic representations illustrating prior art.
Figure 10D:
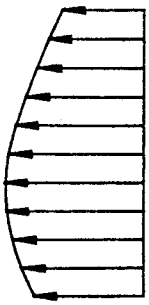
FIG. 10d PRIOR ART
Figure 10B:
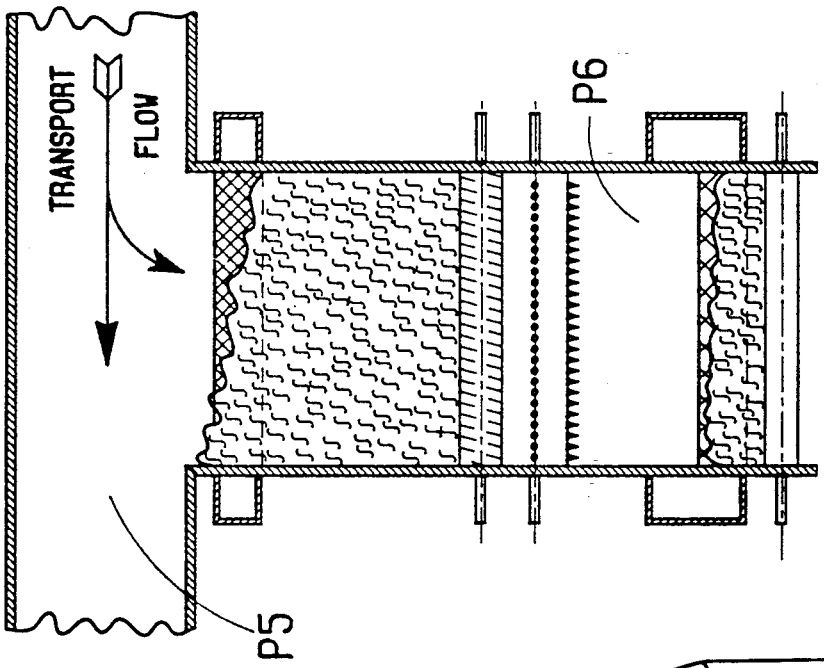
FIG. 10b PRIOR ART
Figure 10A:
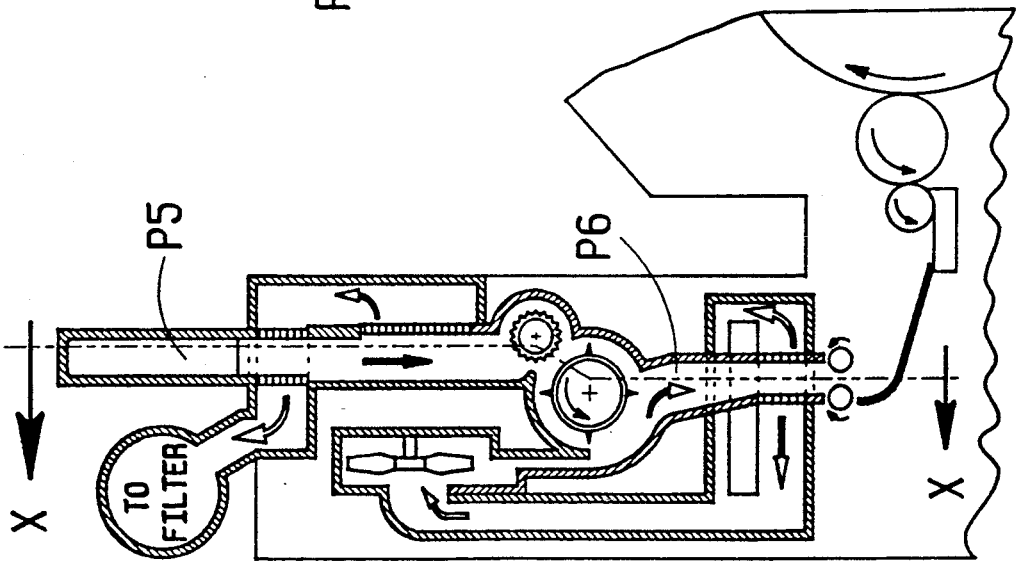
FIG. 10a PRIOR ART

Referring again to prior art FIGS. 10*a* and 10*b*, they show that static pressure P5 must greater than P6 in order to feed fibers into the feed roll. Since there is an upper limit as to how high static pressure P5 can be raised without nuisance choking in the main transport duct, A limit is imposed on how high the value of static pressure P6 can be raised to pack the fibers in the lower batt compacting chamber. Referring to FIG. 8, according to the present invention, static pressure P1 can be raised to a very high value, for enhanced fiber compaction, without adversely interfering with the transport static pressure P4. Furthermore, none of the fans 52, operating in a group of batt formers A, "fight" against the main transport fan. Clearly, the present invention offers significant advantages over the prior art from a pressure balance sensitivity and system fiber feeding reliability point of view, as well as an enhanced fiber compaction potential, due to a higher permissible static pressure P1.

While FIG. 8 shows fiber being supplied to batt former(s) A using a "transverse" fiber distribution system (cards arranged, side-by-side), it will be readily recognized that batt former(s) A can likewise be fed fiber using a "longitudinal" fiber distribution system (cards arranged, end-to-end). Using a "transverse" fiber distribution system, the density profile across inlet opening 52 may be skewed to one side or the other of batt former A. However, this is inconsequential because the fiber column is completely destroyed by opening roll 28 and reassembled downstream in batt forming chamber C, in a controlled manner, to yield a desired exiting cross-directional density profile.

Figure 9:
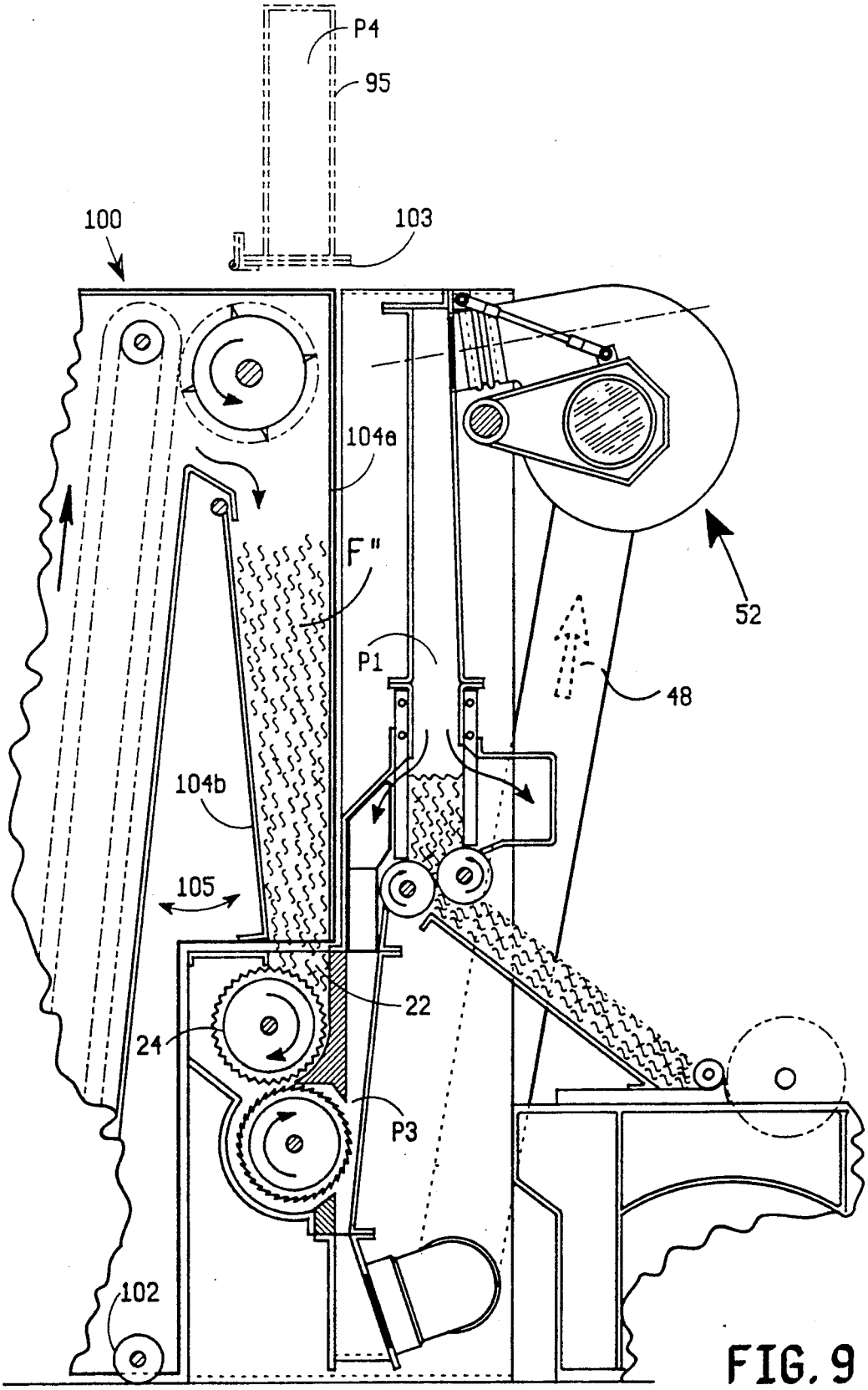
FIG. 9 is a schematic sectional side elevation view of a hopper feeder being used as a means to supply fibers to the present invention.

As can best be seen in FIG. 9, fiber transfer assembly 94 (FIG. 8) can be simply slid out of the way (for example, on a simple track means—not shown), and replaced by a conventional hopper feeder, shown generally at 100, which has been rolled into position by means of wheels 102 in order to supply fiber to batt former A. In this embodiment, a hinged cover plate 103 fastened to main transport duct 95, may be closed to seal the main transport duct as it passes above the batt former A. Consequently, the common fiber supply system distributing fibers via transport duct 95 can continue to feed fiber to various batt formers, located on either side of the illustrated batt former A, without interference. The change-over from one method of fiber supply to the other can be accomplished easily and rapidly with a minimum of down-time.

In hopper feeder 100, a column F″ of fiber is supplied to inlet opening 22 by means of a reserve chute comprised of a front wall 104*a* and a back wall 104*b*. Back wall 104*b* may take the form of a conventional spanker plate and be reciprocated back and forth in the directions of arrow 105. As mentioned above, the static pressure occurring at inlet opening 22 is neutral to slightly negative and, therefore, cannot adversely interfere with the feeding of fibers into feed roll 24. Referring to FIG. 9 and prior art FIGS. 10*a* and 10*b*, it can be seen that fibers in the reserve chute formed by walls 104*a* and 104*b* of hopper feeder 100 could not be fed into the prior art feed roll. The high static pressure P6 existing in the prior art devices would simply blow the fiber up and away from the feed roll. This combination of fiber supply methods is impractical.

Hopper feeder 100 represents the most flexible fiber distribution system known (individually, card-to-card), since batt former A can accept fibers from either "transverse" or "longitudinal" pneumatic fiber distribution systems with equal ease, and since the change-over from any method of fiber supply to the other is readily accomplished, it is clear that the present invention offers a universal feeding module having broad processing applications. The present invention allows textile mills the opportunity to reap the increased profits offered by the "just-in-time" and "quick response" operating concepts, and without the disadvantages heretofore encountered.

Figure 11:
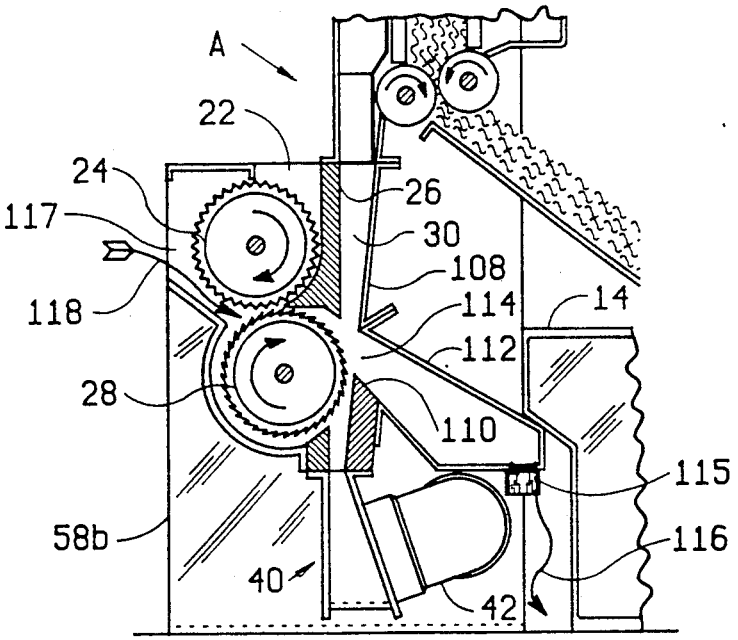
FIG. 11 is a schematic side elevation view showing a way the present invention may be adapted for additional cleaning of the fibers being processed.

Referring now to FIG. 11, front plate 32, comprising one wall of acceleration channel 30 (FIG. 1) has been replaced by a short front plate 108, a mote knife 110, and a mote box 112, all of which span the inside working width of batt former A. Trash particles, such as pieces of leaf, stalk, dirt, "pepper trash", and other impurities known to accompany certain textile fibers, loosened by the intense "opening" action of opening roll 28 may be hurled by centrifugal forces (due to their larger mass) through inlet opening 114 into mote box 112. Mote knife 110 may also have substituted for it a plurality of mote knives comprised of triangular shaped bars, each having a sharp edge disposed to engage the fibers in transit. If desired, a pneumatic connection to mote box 112, such as illustrated by a pipe means 115, may be made whereby a relatively small amount of airflow, either intermittent or continuous may be used to suck the trash from mote box 112. This airflow conveys the same to a filtration system by a ducting means, such as indicated generally at 116. In this case, the air removed from the recirculating fiber conveying loop of batt former A, is easily replenished by room air drawn in through inlet opening 117, as indicated generally at 118.

In either case, the static pressure situation existing at stock inlet opening 22 again is not adversely affected. The present invention is always "pneumatically referenced" to the room static pressure by means of inlet opening 117. This offers significant operating advantages over the prior art.

An improved carding machine, which can run at superior production rates, results when the present invention is incorporated with a conventional carding machine, because the opening and cleaning potential of two independent licker-in cylinders, both having tight nip points to work from, is available. As applied to a carding machine, the present invention provides a superior combination to prior art systems, which added either one or two licker-in cylinders in series with, and downstream of, the regular licker-in cylinder. In this latter case, only one tight nip point is available to work from (at the regular licker-in). The "opening" action of the second or third licker-ins is far less efficient because the fiber restraining forces each works against is merely the fiber / tooth entanglement forces existing on the surface of the slower moving preceding roll, and the inertial forces involved in snatching fibers from it. Since the angle of the teeth of the previous roll is pointed in the same direction as the snatching forces on the following roll, the forces of fiber restraint are probably ten orders of magnitude lower than when a tight nip point, such as a feed roll / feed plate combination, is used. It can thus be seen that other expedients and objects of the present invention also provide advantageous in combination with a carding machine such as accurate control of the fiber profile in batt 10 and fiber separation feed roll 12 of the carding machine providing uniform card production. Consequently, the present invention provides substantial advantages over the prior art.

It can thus be seen that an advantageous air circulation loop can be provided for a batt former wherein static pressures can be established as expedients for enhanced fiber compaction, diverse fiber feeding, fiber opening, fiber cleaning, and fiber distribution in the fiber compacting chamber for forming and feeding fibers to a carding machine having a desired cross-directional profile. This air circulation loop advantageously includes air propelling means 52, plenum means B, air separation means 72, 74, deflecting plate 87, side channels 91*a*, 91*b*, acceleration channel 30, and duct means 90. Fiber compacting chamber C and fiber opening roll 28 are disposed in working relation to the air circulation loop. The air recirculates in the air circulation loop without exhausting the transport air back into the environment resulting in decreased energy consumption for the air fan.

Figure 12:
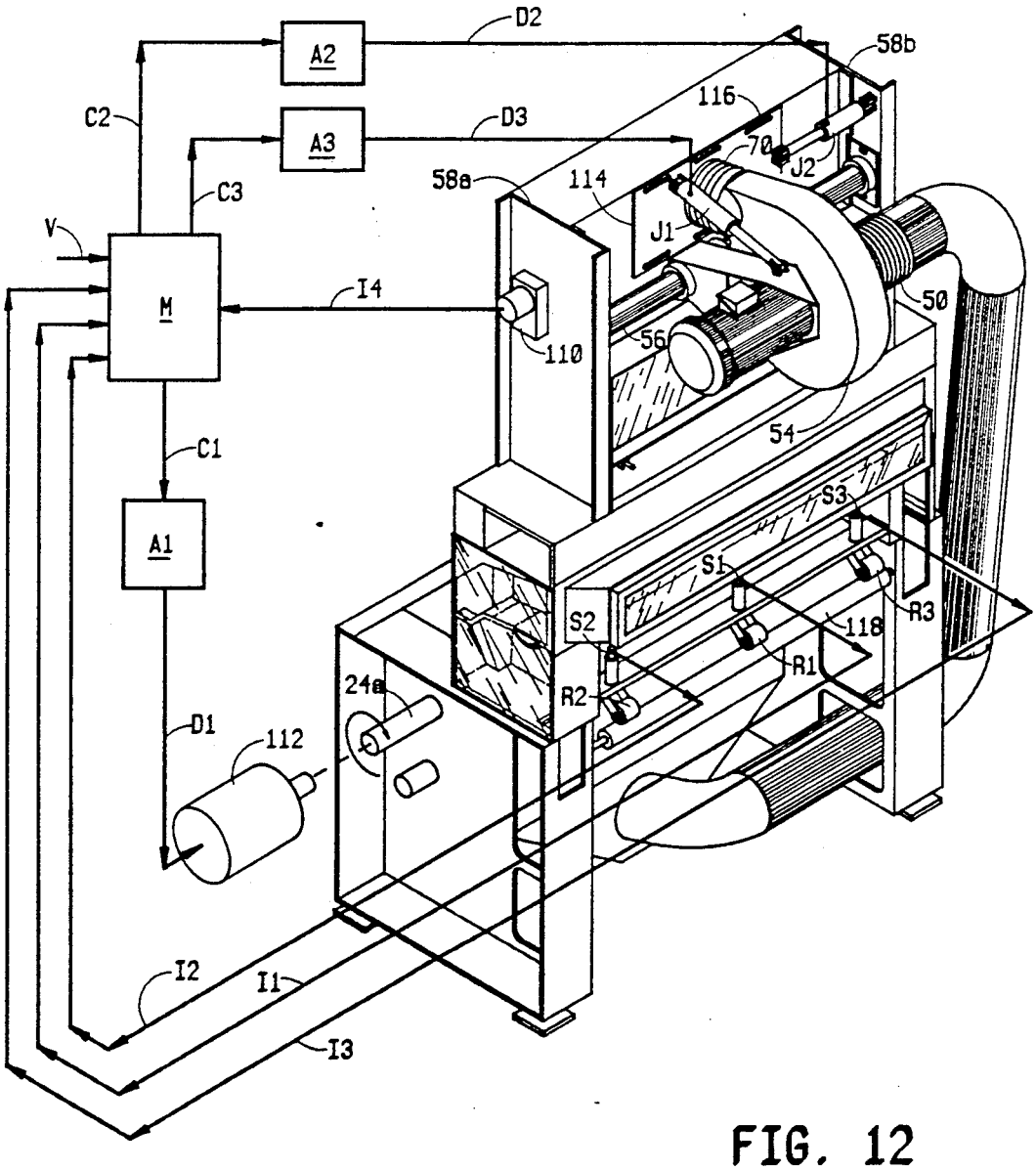
FIG. 12 is a perspective view illustrating automatic control of a textile fiber processing apparatus and method according to the invention.

Referring now to FIG. 12, there is shown a front perspective view of batt former A, as would be seen from carding machine 14, illustrating a control system in schematic form which is versatile and permits several types of controlling possibilities.

In the present invention it is contemplated that a controller means would include a controller M which may be a micro-processor based control system which generates output signals, in response to various input signals, in a programmable manner. Such output signals are capable of operating various speed controller and actuator means after passing through suitable power amplifier means which are illustrated as A1, A2, and A3. Since the design and programming of such devices is well known to those skilled in the art, the present description will be directed toward describing how the various output control signals are generated in response to the various input signals. Input signal V is representative of one or more input signals which may be provided to controller M to serve as reference values, default values, preset values, or other system operating values which may be associated with the process and which may come from various sensors or transducers.

A variable speed means, suitable for driving feed roll 24, may be constructed which would include a variable speed motor 112 which is drivingly connected to journal 24*a* of feed roll 24 to drive feed roll 24 and a motor speed controller A1. Motor controller A1 may be any suitable speed controller readily available from many commercial sources. Such devices are designed so that they can control the power drive signal D1 applied to motor 112 in response to an input speed reference signal speed control signal C1 in order to vary or control the speed of the motors.

By suitable porting, a pressure sensor means pressure transducer 110 may be connected to the plenum or spray chamber B such that a pressure signal I4 may be generated which is indicative of the instantaneous compaction static pressure P1 operating in the spray chamber 8. Pressure transducers, such as model P-3061-5WG manufactured by Schaevitz Engineering Company of Pennsauken, N.J. may be used to perform this function.

In one mode of operation contemplated for the present invention, it may be desired to form batt 10 using a stable or constant compaction pressure P1. In this instance controller M would be programmed to "read" a reference value from input V and compare it to the input pressure signal I4 and from these two signals determine a differential which becomes an operating value. Thereafter, controller M would endeavor to hold this operating value stable by varying speed control signal C1 in such a way as to feed variable amounts of fibers into the batt compaction chamber C. The system's net flux of fibers the amount being fed in relative to the amount being discharged by feed rolls 76*a* and 76*b* governs the amount of air passages of screens 74 and 72 which are instantaneously blocked by the opened stock fed into the batt forming chamber C and this in turn varies the pressure drop occurring across said screens which in turn varies the instantaneous compaction pressure P1 which is reflected by pressure signal I4 being input to the controller M. Thus, by varying the speed of feed roll 24 controller M can cause batt 10 to be formed with a fairly constant compaction pressure P1. As will be described below, there are some circumstances where it may be desired to form the batt 10 using an adjustable or variable batt compaction pressure P1, rather than a constant value.

The control system schematically shown on FIG. 12 may be used also to automatically control the formation of batts having both desired process flow directional and cross-directional density profiles. Referring now to FIG. 1, inlet hole 71 in front splash plate 62 may be made in the form of an elongated hole or slot in the crosswise, or side-to-side, direction. Referring back to FIG. 12, slide plate 114 is placed over the elongated opening 71. By means of pins (not shown) passing through slots such as shown typically by 116 and captive means (not shown) affixed on the pins on the near side of the slide plate to press against it, a mechanism is provided whereby slide plate 114 may be held tightly against front splash plate 62 to prevent air leakage to the environment and yet allow it to slide from side to side freely. Linear actuator J2 is clevis mounted at each of its ends between slide plate 114 and side plate 58*b*, and this actuator means provides a lateral adjusting means whereby slide plate 114 can be readily moved from side to side with respect to a center line drawn through batt former A. Linear actuator J2 may be any of the several types which are commercially available, for example, model Electrak 205 manufactured by the Warner Electric Brake & Clutch Company of South Beloit, Ill. Such devices are designed so that by simply switching the power input leads by power amplifier A2 the actuator may be caused to either extend or retract when power is applied, as indicated by drive signal D2. The model linear actuator defined above also includes position feedback output signals (not shown), indicative of the location of the end of the actuator, which may be used as an input to either power amplifier A2 or controller M depending on the preference of the designer. In the manner just described, power amplifier A2 acting in response to control signal C2 from controller M can cause the impact position of the fiber laden airstream passing through fan casing 54 to be moved laterally relative to back splash plate 66, thereby permitting the side-to-side or cross-directional distribution of fiber within the batt forming chamber C to be controlled.

A second linear actuator J1 may be swivel mounted at both its ends between slide plate 114 and frame 55 which supports fan casing 54 which is pivotably mounted on axle bar 56. In a similar manner to that just described, linear actuator J1 provides an angle adjusting means be which the angle of incidence "a", between the fiber laden air flow and back splash plate 66, may be altered in response to control signal C3 applied to power amplifier A3 which provides drive signal D3 which controls actuator J1.

With the system just described, controller M can alter the cross-directional distribution of fibers in the batt forming chamber C by manipulating the control signals C2 and C3 in response to Density input signals I1, I2, and I3 which are indicative of the local batt density occurring at several places disposed across batt 10. For example, if it is desired to form a batt having a uniform cross-directional density profile, such as illustrated by FIG. 5, controller M would be programmed to first manipulate actuator J2 via control signal C2 as necessary to cause batt density signals I2 and I3 to deliver equal value signals to controller M, I2 and I3 being taken to represent the batt density occurring near the two outside edges of batt 10. Once this state is reached, controller M would then alter linear actuator J1 via control signal C3 to adjust the angle of incidence such that batt density signal I1 becomes equal in value to density signals I2 and I3. Naturally, if either concave or convex batt density profiles such as illustrated by FIG. 6 or FIG. 4 are desired, controller M would be programmed to manipulate actuator J1 as required to cause density signal I1 to be either lesser than, or greater than, density signals I2 and I3 by the prescribed amount needed to define the non-linear profile.

As previously mentioned, there are some occasions where it may not be desirable to form a compacted batt using a constant fiber compaction pressure. This comes about because the response of textile fibers to the compaction pressure applied and the resulting density of the batt which is formed is affected by such variables as temperature, moisture content and fineness of the fibers under process. For a given pressure, limp fibers pack more densely than stiff fibers. To compensate for these processing variables it may be desired to use one or more of the batt density signals to control the instantaneous compaction pressure P1 indicated by pressure signal I4 so that the batt density delivered from batt former A can be held at a stable value. In this situation, controller M would be programmed to "read" the appropriate batt density input signal (or plurality of density signals which can be integrated to determine an average cross-directional batt density signal) and, thereafter, controller M continuously adjusts the reference value to which pressure signal I4 is compared. In this fashion, controller M continuously determines a variable operating value which adjusts speed control signal C1 which adjusts the speed of the feed roll 24 to feed the correct amount of fibers into the batt compacting zone C so that the density of the batt delivered remains constant. In other words, the pressure reference value is constantly up-graded as required to yield a constant batt density signal.

There are a number of ways by which density signals I1, I2, and I3 can be obtained. For example, it is known that energy absorption measurement devices (nuclear, electromagnetic, and sound pressure) can be disposed across batt 10 to provide signals indicative of the local batt density at several places. By compressing a batt with a roller and measuring the thickness of the fibers nipped between the roller and another surface one may obtain a fairly accurate measure of the density of the batt. For the purposes of describing the present invention, a plurality of thickness measuring rollers R1, R2, and R3 will be described to illustrate a batt density sensing means which is usable. Rollers R2 and R3 are disposed as shown in FIG. 12 to provide density signals representative of conditions near the outside edges of batt 10 and roller R1 may be disposed near the medial region to provide an indication of the density of the batt in this zone. The rollers are floatably mounted to a bridging member (not identified) which spans between side plates 58*a* and 58*b* to position the rollers with respect to the frame. Biasing means, such as springs, may be used at each roller to suitably compress the batt to provide an accurate thickness signal at each roller position. To minimize disturbances to the batt as a result of the rollers, a drive roll 118 may be coaxially mounted with respect to said rollers across the full width of batt former A to provide driving traction to the under portion of batt 10 and to provide a surface against which each of said rollers may nip the batt. This full-width driving roll (118) should be driven in some proportional speed to feed rolls 76*a* and 76*b* to carry the batt toward the card 14 with the appropriate amount of tension draft. Thickness sensors S1, S2 and S3 are also mounted on the bridging framework to provide a measure of the displacement of each roller, up and down, in response to the amount of fiber nipped between each respective roller and the driving feed roll 118 beneath the batt 10. Such displacement sensors may be any of those commonly and commercially available, such as precision gauge heads model PCA-117-300 as manufactured by the Schaevitz Engineering Company of Pennsauken, N.J. Such devices provide an amplified electrical signal which is indicative of the movement of a contact tip which is placed to measure the movement of each of the respective sensing rollers R1, R2 and R3 relative to the driving feed roller 118.

Variable speed transmissions, whose output speed is governed by a speed control signal, or fluid driven motors, whose output speed is controlled by regulating the fluid flow through such devices, may be substituted for the variable speed electrical motor 112 shown in FIG. 12. Likewise, linear actuator J2 may be attached directly to fan casing 54 with a suitable mounting means such that fan 52 itself may be slid from side-to-side along axle bar 56 which would eliminate the need for using slide plate 114. In this case, flexible duct 70 could then be attached directly to front splash plate 62 since fan casing 54 would be movable to provide the side-to-side or lateral controlling of the flow into spray chamber B. Furthermore, fan casing 54 may be mounted in a gimbal mechanism which is supported by the frame of batt former A and said gimbal mechanism would permit fan 52 to be operated in two planes of motion relative to back splash plate 66, and by suitable mounting of linear actuators like J1 and J2 fan casing 54 may then be swivelled in two planes to vary the angles of incidence between the fiber laden air flow and back splash plate 66. Fluid operated pistons, cam mechanisms, and the like, may be substituted for actuators J1 and J2 when provided with the appropriate mounting and driving means.

For the purpose of the present specification, fibers shorter than one half inch (12 mm) shall be referred to as "short fibers". In the textile trade such short fibers are often referred to as "non-spinnable lint". Although short fibers can be spun, they cannot be easily spun into high quality, high strength yarns. All fibers processed—even man made fibers—contain some short fiber content. Natural fibers, especially cottons, are prone to have an even higher percentage of short fibers because of the nature of their development and growth.

It is well known in the art that one of the primary things which hinders the spinning of high quality yarns is the presence of high and varying concentrations of short fibers along the strand. When high concentrations of short fibers are present a hairy yarn is likely to be produced. Likewise, when high concentrations of short fibers are present the yarn produced usually contains high numbers of thick and thin places, because of a loss of control of the fibers in the various drafting processes employed. The resulting uneven yarn not only has a poorer appearance, but also tends to be much weaker than an even yarn.

Historically, if one desired to make a good quality yarn there were two choices. One could either purchase high grade (high priced) fibers, which contain a relatively low percentage of short fibers within the bales, or one could purchase an average grade of fibers, which had a higher percentage of short fibers, and pass this batch of fibers through the well known combing process. Furthermore, if one desired to produce a very high quality yarn then the decision usually boiled down to just one option; purchase both a high grade of fiber as well as pass them through a combing operation.

As is well known, comber machines remove both a portion of the short fibers and small trash particles present in the lap in order to improve the quality of the fibers delivered for subsequent spinning. It is likewise well known that combers—because of their complicated reciprocating and indexing mechanisms—are quite expensive from both capital and operational points of view. Furthermore, they have high maintenance requirements. If the settings of the various mechanisms of combers are not properly made and rigorously maintained, then the resulting condition of the fibers leaving these devices can be of a poorer quality than when they entered the process.

In view of all the foregoing factors, there is clearly a great economic benefit to be had by the textile industry if one could spin a high quality yarn, using only average grade fibers, without having to resort to passing them through the expensive combing operation. The present invention provides such an alternative approach to yarn making. This comes about because the present invention provides a means of selectively sorting fibers by length—and of purifying them by extracting both trash particles and short fibers prior to the carding process—such that, in many applications, the combing operation can be eliminated.

Referring now to FIG. 1, it has been observed that while screen assemblies 72 and 74 are highly efficient in condensing long spinnable fibers from the recirculating transport air loop, a high percentage of the undesirable shorter fibers, trash particles and dust can be made to pass through the slotted air passages of said screens. As a consequence, the air flowing around and around in the recirculating air loop can be caused to become highly enriched with these undesirable elements to yarn making . . . and this facilitates their extraction from the good fibers under process.

Figure 13:
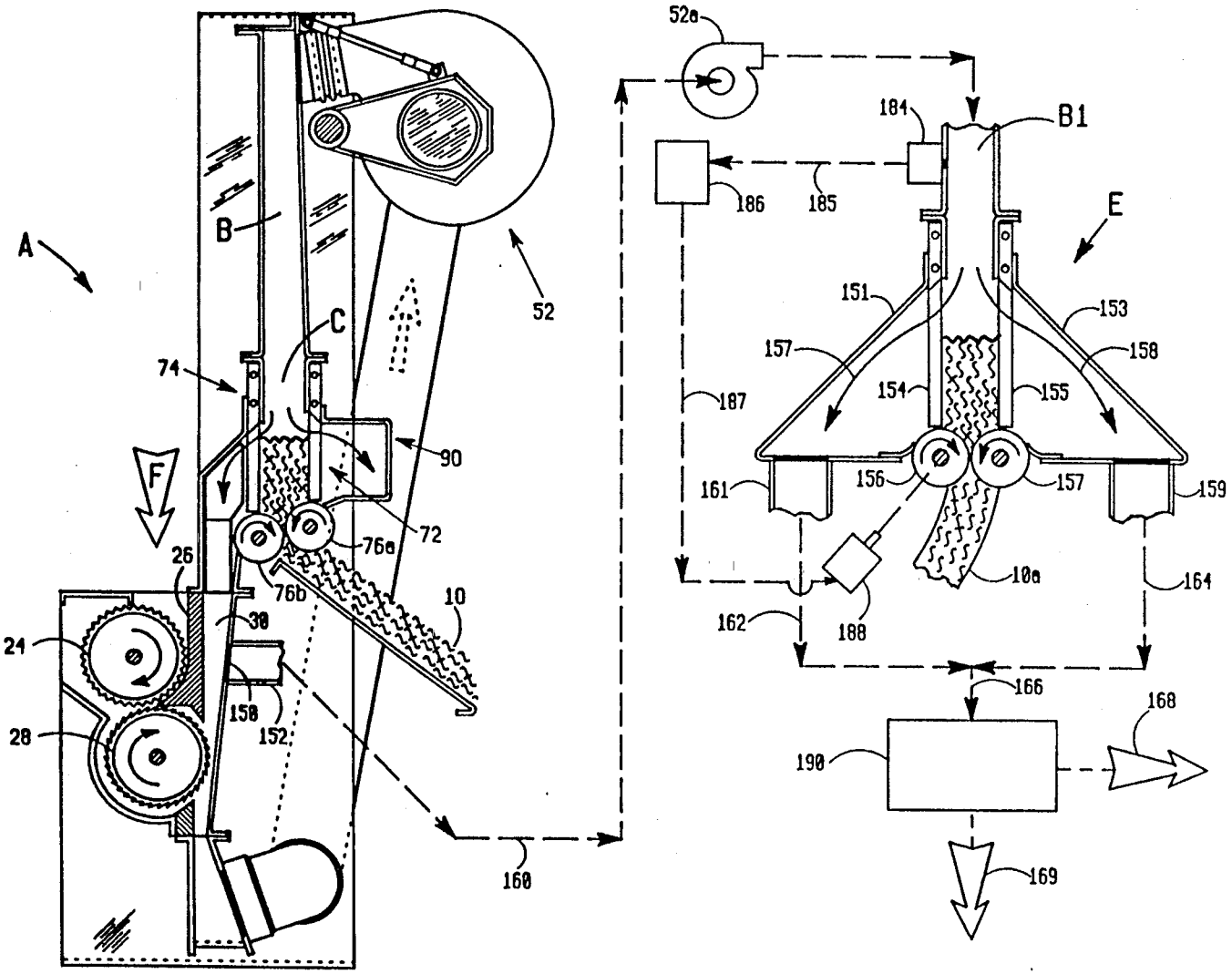
FIG. 13 is schematic sectional side view of a ducting arrangement and an extractor for removing a fraction of air quantity from the recirculating loop.

Referring now to FIG. 13, by placing a suitable port 150 in one wall of the acceleration channel 30 and connecting port 150 to a suitable pneumatic ducting arrangement (illustrated as 152), it is possible to extract a fraction of the air quantity flowing in the recirculating loop of batt former A and direct said fraction along path 160 to a fiber extractor indicated generally at E. Fiber extractor E is comprised of at least one capture hood 151 and a fiber condensing screen 154 which is constructed in a similar manner to the screen assembly illustrated by FIG. 7 (and described above). Extractor E may also include a pair of feedrolls 156 and 157 for removing the batt of fibers 10*a* which is formed therein in a similar fashion to the batt formation operation described previously for batt former A. If desired, extractor E may include also a second capture hood 153 and a second fiber separating screen 155.

The short fiber and trash laden airflow moving along path 160 enters a plenum or spray chamber B1 and exits through screen 154 along the path indicated by arrow 157, through a port (not identified) in capture hood 151 and into a pneumatic connection illustrated as 161 and flows along exit path 162. Alternatively, the flow into extractor E may be split so that a portion of the transport air flows also along the path indicated by arrow 158 and follows flow path 164. Flows 162 and 164 can be merged to form flow path 166 into a high efficiency filtration device which is illustrated as block 190. Cleansed air is shown leaving filter 190 as arrow 168 while the dust and trash particles exit filter 190 along the path indicated by arrow 169.

Referring again to FIG. 1, it has been observed that the amount of short fiber, trash particles and dust blown through separating screens 74 and 72 is a function of the size of the air passages existing in said screens and the velocity of the air passing through the passages between the finger bars of said screens. Using a high velocity permits the increased aerodynamic drag forces of the recirculating air flow to more easily pull the short fibers, which are draped around the finger bars 82, off of these bars and into the recirculating air loop. With this observation in mind, it may be desirable to construct screen 154, and alternatively screen 155, using longer finger bars than are employed in the construction of screens 74 and 72. Thus, for a given fiber column height above feedrolls 156 and 157, the size of the air passages in extractor E can be made larger than are employed in batt former A, which reduces the velocity of the air passing through the air passages of screens 154 and 155, thereby enhancing the retention of short fibers by said latter screens. This larger area is possible because the batt 10*a* formed in extractor E does not have to be formed with as high a compaction pressure as needed in the formation of batt 10—because batt 10*a* is primarily a by-product and does not have the same strict density uniformity requirements as batt 10. Since the airflow quantity along path 160 is only a small fraction of the airflow quantity flowing around and around in the air circulating loop in batt former A, the velocity of the air flowing along paths 157, and alternatively paths 158, in extractor E is inherently much lower (for a comparable width extractor E as batt former A) and consequently this allows extractor E to efficiently remove the much shorter fibers contained therein from the conveying airflow. In the manner just described, the present invention permits the formation of a high quality batt 10 from which much of the shorter undesirable fibers have been extracted and removed from the system in the form of batt 10*a* and this permits the spinning of a high quality yarn without the problems resulting from the inclusion of the shorter undesirable fibers. As can be seen, this is accomplished without having to resort to the complicated comber process, which has been heretofore required in order to accomplish the same objective.

The amount of fiber making up batt 10*a* is only a fraction of the fiber contained in batt 10 (something on the order of 3% to 30% of the latter) and it may be desirable to drive feedrolls 156 and 157 at a different surface speed than feedrolls 76*a* and 76*b* of batt former A in order to compensate for the differences in mass flow rates of the respective batts.

The fibers nipped between feedrolls 156 and 157 form a fiber seal which prevents the fibers within extractor E from being blown into the room, and the column of fibers above said feedrolls forms a seal to prevent fibers from being blown beneath the lower ends of the finger bars of screens 154 and 155. It is desirable to maintain the integrity of these seals at all times during the operation of the device. To accomplish this a pressure transducer 184 may be connected via a port (not identified) into plenum B1 to generate a pressure signal 185 which is fed to a controller 186 which generates a drive signal 187 which is fed to variable speed drive means 188 (such as a variable speed electric or fluid driven motor) which is drivingly connected to feedrolls 156 and 157 to cause their rotation in the counter-directions illustrated. In a manner similar to that described above, the pressure in plenum B1 may be utilized to regulate the speed of feedrolls 156 and 157 such that a continuous column of stock and hence, said seals, can be maintained within extractor E by the controller 186 which regulates the speed of feedrolls 156 and 157 as necessary to maintain pressure signal 185 constant.

There are two ways by which the amount of short fiber contained in bat 10*a* can be adjusted relative to the amount of fiber in batt 10. First, the speed of the fan wheel of fan 52 can be varied—for example, by driving the wheel of fan 52 with a variable speed motor. This changes the velocity of the airflow passing through screens 72, 74 and hence the level of short fiber enrichment of the recirculating airflow loop flowing around and around in batt former A. A higher short fiber enrichment level results in more short fiber being extracted from said recirculating loop for a given extraction airflow rate along path 160—and, vice versa. Secondly, the extraction airflow rate moving along path 160, may be varied—for example, by using a variable speed motor to drive the wheel of fan 52*a*. Increasing the airflow rate along path 160 increases the amount of short fiber available to form batt 10*a*, and vice versa.

A microprocessor based control system—operating in a similar fashion as previously described relative to FIG. 12—may be utilized to vary the speed of feedroll 24 (FIG. 13), in order to vary the amount of raw fiber (Arrow F) fed into batt former A, as needed to compensate for the amount of short fiber being extracted in the form of batt 10*a*. Thus, variations in the extracted short fiber mass flow rate can be corrected so that these do not adversely affect the density or mass flow rate of batt 10. This can be accomplished by first applying a suitable density measuring means to batt 10 (such as a roller R1 working in combination with a thickness sensor S1—see FIG. 12—to furnish a first input signal to the microprocessor indicative of the density of batt 10), secondly, applying a suitable speed detecting means (not shown, but numerous types are readily and commercially available) to generate an input signal indicative of the speed of feedrolls 76*a* and 76*b*, thirdly, programming the microprocessor to compute the instantaneous mass flowrate value of batt 10 as a function of these two input signals (density and speed), fourthly, instructing the microprocessor to "read" a desired preset mass flowrate value for batt 10 and compare it to the computed instantaneous mass flowrate value, and fifthly, programming the controller to adjust the speed of feedroll 24 as required to hold the computed mass flow rate constant at the preset mass flowrate.

Programming of the control system can be carried to an even higher level than just described. Firstly, applying suitable density measuring means also to batt 10*a*, to obtain an input signal indicative of this variable, and applying a speed sensor also to feedrolls 156 and 157, to obtain an input signal indicative of this variable, the microprocessor can be programmed to compute the instantaneous operating mass flow rate of batt 10*a*. Secondly, the instantaneous operating mass flowrate of batt 10 can be computed as described in the previous paragraph. Thirdly, a preset input value, indicative of the actual average percentage of short fiber to total fiber content of the mix to be processed (it is common practice to analyze the fiber properties of the bales to be run beforehand) can be "read", as a first reference value for computational purposes. Fourthly, a "target" maximum short fiber percentage allowable in batt 10 can be "read" as a second reference value for computational purposes. Fifthly, a desired mass flowrate value for batt 10 can be "read" as another preset operating input value. Using these "inputs" it is possible, by suitable programming, for a microprocessor control system to calculate the required target mass flowrate needed for batt 10*a* and to concurrently manipulate the speeds of the motors driving fans 52 and 52*a* as needed to extract this amount of short fibers—and simultaneously vary the motor speed of feedroll 24 as needed to compensate for the rate of short fiber extracted in the form of batt 10*a*—such that the percentage of short fiber contained in batt 10 is held to a maximum pre-determined optimum economic level which does not harm the quality of the yarn to be spun. This ensures that the amount of short fibers removed from the mix is done in a controlled manner which is sufficient to maintain yarn quality, but yet not excessive which would needlessly increase costs.

Although the short fiber contained in batt 10*a* has been referred to above as a "by-product", that does not mean that short fibers have no economic value. Many textile products—such as absorbent medical pads, feminine tampons, mop yarns and the like—are made from fiber mixes which are predominately short fibers. However, when utilized in these ways short fibers have a much lower economic value than when they can be retained and spun as part of a high quality yarn. The present invention provides ways of extracting just the right amount of short fiber to keep the yarn making process at the maximum level of profitability.

Figure 14:
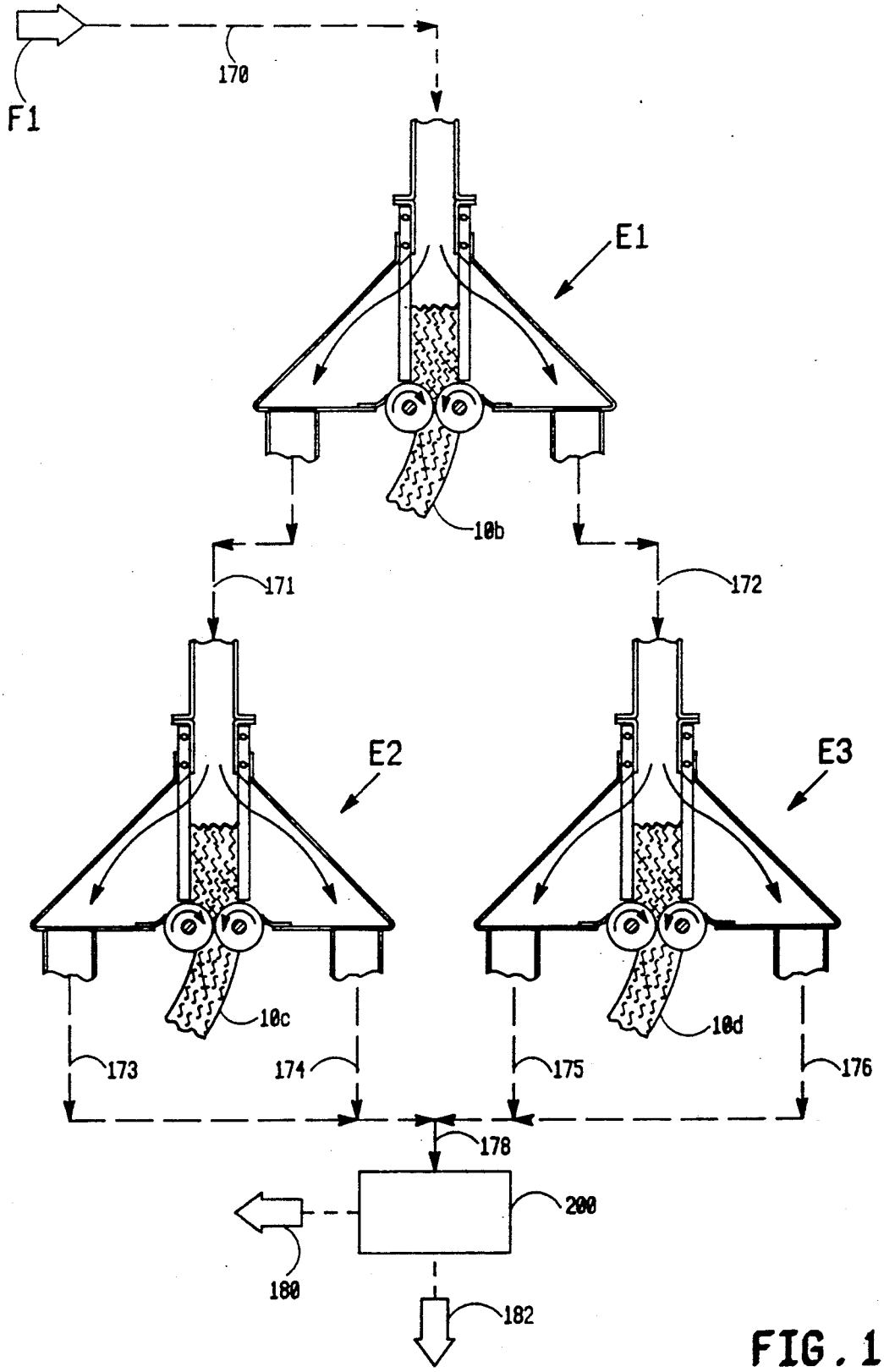
FIG. 14 is a schematic sectional side view of a cascading plurality of fiber extractors according to the invention.

The present invention may be carried to an even higher level of performance sophistication by cascading a plurality of fiber extractors such as is schematically illustrated by FIG. 14. That is to say, the present invention may be used in the making of a very high quality yarn, using only average grade fibers, and still obviate the need for the highly complex and expensive combing operation which has heretofore been needed. Highly opened and liberated fibers (schematically represented by Arrow F1) may be obtained from an intensive opening mechanism, such as feedplate 26, feedroll 24 and opening roll 28. These highly liberated fibers are pneumatically carried along path 170 and into extractor E1 which removes long fibers from the conveying airstream and delivers them in the form of batt 10*b*. The transport air is divided in extractor E1 and flows along paths 171 and 172 into cascaded extractors E2 and E3 which extract shorter length fibers in the forms of batts 10*c* and 10*d*. The transport air leaving extractors E2 and E3 flows along paths 173, 174, 175, and 176 and these may be merged into a path 178 which flows into a high efficiency filter system illustrated as box 200. Cleansed air is shown leaving filter 200 as arrow 180 and the dust and other undesirable trash particles are shown leaving filter 200 schematically as arrow 182. If desired, additional extractors (not shown) may be arranged in a further series cascaded fashion below extractors E2 and E3 to permit additional progressive sorting of the fibers, by fiber length, into shorter and shorter categories. A close examination of FIG. 14 shows that if the assumption is made that the air flow is divided equally in each of the extractors then the velocity of the air through each of the subsequent screens is reduced by half of the velocity through the screens in the previous ascendant extractor. The progressive lowering, or halving, of the velocity of the air flowing through the various screens enhances the extraction of progressively shorter and shorter fiber lengths as one mores further down through the cascaded chain of extractors. Furthermore, if desired, one may assemble additional extractors in parallel with extractors E2 and E3 rather than in series) and in this case the air velocity through the screens would be reduced to one-fourth the velocity in the previous ascendant extractor stage. This ability to assemble extractors in series, in parallel, or in series-parallel combinations permits the designer considerable flexibility in setting the velocity through the screens of each respective extractor; so fiber lengths of different values may be extracted at each level of the cascaded chain in a desired manner.

Additionally, if desired, air propelling means (such as schematically illustrated by fan 52*a*) may be employed along any of the airflow paths 160, 170, 171, 172, 173, 174, 175, 176, and 178. In order to adjust the air pressure along any of these paths to compensate for any pressure losses which may result from the various arrangements which one may use to assemble the various extractors. Where one places such booster fans is primarily a matter of designer's choice and is based primarily upon how the various extractors are assembled and ducted together.

Having cascaded or sorted batts of progressively shorter average fiber lengths provides textile yarn makers a very powerful tool which allows them the capability to custom engineer the average fiber length of the mix they will ultimately spin into yarn. By selecting from the various combinations of fiber length batts—and mixing and blending these batts in any of the several ways well known to textile makers—one can design and achieve the optimum fiber length mix. That is: enough short fiber can be utilized to minimize fiber value at which they begin harming the quality of the yarn produced. To achieve this capability, using simply constructed pneumatic extractors or sorters—whose only moving parts are a pair of feedrolls, which rotate in only one direction, as compared to the expensive operation of complex comber machines and all their related complications—truly represents a significant simplification to the art of, and the cost of, high quality yarn making.

While a preferred embodiment of the invention has been described using specific terms, such description is for illustrative purposes only, and it is to be understood that changes and variations may be made without departing from the spirit or scope of the following claims.

What is claimed is:

1. Textile apparatus for forming a fibrous batt having a prescribed density profile and being comprised of sorted textile fibers, said apparatus comprising:

fiber supply means for supplying raw textile fibers;

a first air flow path;

fiber opening means receiving said raw textile fibers from said fiber supply means for loosening and separating said raw textile fibers to produce opened fibers and for introducing said opened fibers to said first air flow path;

air propelling means creating an air flow for transporting said opened fibers along said first air flow path;

first fiber extraction means associated with said first air flow path for extracting fibers having an average length greater than or equal to a preselected length from said air flow to produce useful long fibers and create a separated air flow containing useful short fibers having an average fiber length less than said preselected length to continue along in said separated air flow;

fiber compacting means for compacting said useful long fibers into a compacted batt and discharging said compacted batt from said apparatus.

2. The apparatus of claim 1 including at least one second fiber extraction means for extracting useful fibers not extracted by an antecedent fiber extraction means.

3. The apparatus of claim 1 wherein said first fiber extraction means includes at least one screen comprised of a plurality of spaced fingers disposed to intercept the flow of said opened fibers.

4. The apparatus of either claims 1, 2 or 3 including plenum means for distributing said opened fibers in said textile apparatus to yield a prescribed cross-directional density profile in said compacted batt.

5. The apparatus of claim 4 wherein said plenum means includes a spray chamber having a splash plate and flow directing means for distributing said opened fibers against said splash plate to create said prescribed cross-directional density profile using momentum of said opened fibers and currents of said air flow.

6. The apparatus of claim 5 wherein said flow directing means includes angle adjusting means for adjusting at least one angle of incidence between said splash plate and said flow directing means to enhance the distribution of said opened fibers in said plenum and textile apparatus.

7. The apparatus of claim 6 wherein said angle adjusting means includes:

at least one actuator means for adjusting an angular orientation of said flow directing means with respect to said splash plate;

density sensing means disposed to measure said cross-directional density profile of said compacted batt delivered from said textile apparatus for generating density signals indicative of a local density of said compacted batt at a plurality of cross-directional places across said compacted batt; and controller means responsive to said density signals for generating at least one control signal for operating said actuator means to adjust said angular orientation of said flow directing means with respect to said splash plate;

whereby deviations occurring in said cross-directional density profile of said compacted batt from a prescribed value are detected and corrected by adjusting the distribution of said opened fibers in said textile apparatus by said flow directing means.

8. The apparatus of claim 5 wherein said flow directing means includes lateral adjusting means for adjusting a cross-directional position of said flow directing means with respect to a centerline through said textile apparatus to adjust a cross-directional region where said opened fibers are caused to strike said splash plate.

9. The apparatus of claim 8 wherein said lateral adjusting means includes:

at least one actuator means for adjusting said cross-directional position of said flow directing means with respect to said splash plate;

density sensing means disposed to measure said cross-directional density profile of said compacted batt delivered from said textile apparatus for generating density signals indicative of a local density of said compacted batt at a plurality of cross-directional places across said compacted batt; and controller means responsive to said density signals for generating at least one control signal for operating said actuator means to adjust said cross-directional position of said flow directing means with respect to said splash plate;

whereby deviations occurring in said cross-directional density profile of said compacted batt from a prescribed value are detected and corrected by adjusting the distribution of said opened fibers in said textile apparatus by said flow directing means.

10. The apparatus of claim 4 wherein:

said fiber compacting means includes an instantaneous compaction pressure for compacting said useful long fibers to form said compacted batt;

said fiber opening means includes at least one feed roll driven by a variable speed means responsive to a speed control signal for governing an amount of said opened fibers introduced per unit time to said air flow path;

said air separation means includes at least one screen having a plurality of air exit passages, an instantaneous pressure drop occurring across said screen being governed in part by a proportion of said air exit passages blocked by said opened fibers at any given instant; and said plenum means contains said instantaneous compaction pressure.

11. The apparatus of claim 10 including:

pressure sensor means associated with said plenum means for generating a pressure signal indicative of said instantaneous compaction pressure existing within said plenum means; and a controller means responsive to at least one input signal for comparing said pressure signal against a reference value and for generating said speed control signal applied to said variable speed means;

whereby the amount of said opened fibers fed per unit time is adjusted so that said compacted batt delivered from said apparatus is formed in part by a controlled pressure.

12. The apparatus of claim 11 including batt density measuring means for generating a density signal indicative of a density condition existing at at least one place in said compacted batt, said density signal becoming one of said at least one input signal applied to said controller means.

13. Textile apparatus for forming a batt of textile fibers having a prescribed cross-directional density profile and a high degree of fiber separation, said apparatus comprising:

fiber supply means for supplying said textile fibers;

an air circulation loop;

fiber opening means receiving fibers from said fiber supply means for loosening and separating said fibers to produce opened fibers;

air propelling means creating an air flow for transporting said opened fibers along said air circulation loop;

fiber compacting means for forming a compacted batt of said opened fibers and discharging said compacted batt from said apparatus;

air separation means for separating a substantial portion of said opened fibers from said air flow and preventing said separated opened fibers from recirculating around said air circulation loop;

said fiber compacting means includes an instantaneous compaction pressure for compacting said opened fibers to form said compacted batt;

said fiber opening means includes at least one feed roll driven by a variable speed means responsive to a speed control signal for governing an amount of said opened fibers introduced per unit time to said air circulation loop and thence to said air separation means;

said air separation means includes at least one screen having a plurality of air exit passages, an instantaneous pressure drop occurring across said screen being governed in part by a proportion of said air exit passages blocked by said opened fibers at any given instant; and a plenum means for distributing said opened fibers near said air separation means and containing said instantaneous compaction pressure.

14. The apparatus of claim 13 including:

pressure sensor means associated with said plenum means for generating a pressure signal indicative of said instantaneous compaction pressure existing within said plenum means; and a controller means responsive to at least one input signal, said at least one input signal being said pressure signal, for comparing said pressure signal against a reference value and for generating said speed control signal applied to said variable speed means;

whereby the amount of said opened fibers fed per unit time is adjusted so that said compacted batt delivered from said apparatus is formed in part by a controlled pressure.

15. The apparatus of claim 14 including batt density measuring means for generating a density signal indicative of a density condition existing at at least one place in said compacted batt, said density signal becoming one of said at least one input signal applied to said controller means.

16. Textile apparatus for forming a batt of textile fibers having a prescribed cross-directional density profile and a high degree of fiber separation, said apparatus comprising:

fiber supply means for supplying said textile fibers;

an air circulation loop;

fiber opening means receiving fibers from said fiber supply means for loosening and separating said fibers to produce opened fibers;

air propelling means creating an air flow for transporting said opened fibers along said air circulation loop;

fiber compacting means for forming a compacted batt of said opened fibers;

stationary air separation means for separating a substantial portion of said opened fibers having a length greater than a preselected length from said air flow to produce separated opened fibers that are compacted in said fiber compacting means and for creating a separated air flow containing short opened fibers having a length generally less than said preselected length;

a connection port in fluid communication with said air circulation loop downstream of said air separation means for extracting a part of said separated air flow in said air circulation loop to form a fractionalized air flow; and a fiber extracting means for separating said short opened fibers from said fractionalized air flow and creating a second separated air flow which exits said fiber extracting means along at least a first exit air path.

17. The apparatus of claim 16 wherein said fiber extracting means includes a batt forming means for forming a second fiber batt from said short opened fibers.

18. The apparatus of claim 17 including control means for controlling a percentage of short fibers in said first fiber batt by controlling the amount of short open fibers extracted to form said second fiber batt.

19. The apparatus of claim 16 comprising:

a plenum for receiving said fractionalized air flow containing said short opened fibers and impurities upstream of said fiber extraction means.

20. The apparatus of claim 16 comprising a second exit air path for the exit of said second separated air flow from said fiber extracting means.

21. The apparatus of claim 20 comprising:

means for merging said first and second exit air paths to create a merged air flow; and filter means for receiving said merged air flow for filtering said merged air flow.

22. The apparatus of claim 20 wherein said fiber extracting means comprises:

at least one screen disposed in a cross flow direction to a flow direction of said fractionalized air flow;

said screen including a series of elongated slot openings having opposed planar side surfaces extending in the flow direction of said separated air flow; and said planar side surfaces having a dimension in the flow direction of said separated air flow passing through said screen substantially greater than a dimension of said slot openings in a cross flow direction to define deep narrow exit air passages facilitating an orderly flow of exit air through said screen without degradation of said textile fibers.

23. The apparatus of claim 22 wherein said screen includes a series of elongated finger bars spaced in said cross flow direction alternately laminated with adjustable spacer means disposed between said finger bars for providing a prescribed spacing between adjacent finger bars and creating said slot openings; and said finger bars have opposed planar side surfaces extending in the flow direction of said separated air flow.

24. The apparatus of claim 23 wherein said adjustable spacer means includes spacer bars arranged between adjacent finger bars, and means for affixing an adjustable number of said spacer bars between said finger bars.

25. The apparatus of claim 24 wherein said finger bars terminate in free ends, and said spacer bars terminate short of said free ends of said finger bars to define said exit air passages.

26. The apparatus of claim 25 wherein said free ends of said finger bars are made to terminate on a common line and a distance from said common line to each respective terminal end of the alternately interposed spacer bars is made adjustable or variable thereby creating a plurality of variable length air exit passages disposed across said screen in a predetermined fashion to govern the cross-directional distribution of said opened fibers delivered at said fiber compacting means.

27. The apparatus of claim 24 wherein said spacer bars terminate in slanted ends to guide said separated air flow.

28. The apparatus of claim 16 wherein said fiber extracting means includes a first screen and a second screen, and means for creating a lower static pressure drop across said first air screen than said second screen.

29. The apparatus of claim 28 wherein said means for creating a lower static pressure drop across said first screen includes air exit passages in said first screen initiating farther upstream in the air flow than exit passages in said second screen.

30. The apparatus of claim 16 wherein said air propelling means is positioned in said air circulation loop between said fiber opening means and said fiber compacting means.

31. Apparatus for sorting textile fibers by length comprising:

fiber supply means for supplying said textile fibers;

fiber opening means receiving said fibers from said fiber supply means for loosening and separating said fibers to produce opened fibers;

air propelling means creating a first air flow for transporting said opened fibers;

first fiber extracting means for separating a first portion of said opened fibers from said first air flow and dividing said first air flow into at least a second and third air flow containing the remaining opened fibers having a length generally shorter than the length of said fibers separated from said first air flow;

a second fiber extracting means for separating a substantial portion of said remaining opened fibers in said second air and dividing said second air flow into at least a fourth air flow containing opened fibers having a length generally shorter than the length of said fibers separated from said second air flow; and at least a third fiber extracting means for separating a substantial portion of said remaining opened fibers in said third air flow and dividing said third air flow into at least a fifth air flow containing opened fibers having a length generally shorter than the length of said fibers separated from said second air flow.

32. The apparatus of claim 31 wherein each said fiber extracting means includes:

a plenum receiving a respective air flow; and a batt forming means for forming a fiber batt from the respective separated opened fibers extracted from the respective air flow.

33. The apparatus of claim 32 including:

a pair of feed rolls included in each said batt forming means disposed below a fiber column containing compacted fibers which form a seal with said feed rolls so that fibers are not blown into a room in which said extracting means is located, and said feed rolls remove fibers from said fiber column to form said first fiber batt;

pressure monitoring means for sensing a function of pressure in said plenum means and generating a corresponding pressure signal;

drive means for rotatably driving said feed rolls; and control means responsive to said pressure monitoring means for controlling said drive means and hence the rotational speed of said feed rolls to maintain a desired level of said fibers in said fiber column and a desired corresponding pressure in said plenum means so that said seal is effectively maintained and said fibers are adequately compacted for formation into said compacted fiber batt.

34. The apparatus of claim 31 including flow merging means for merging at least said fourth and fifth air flows into a merged air flow and for filtering impurities from said merged air flow.

35. The apparatus of claim 31 wherein each said fiber extracting means comprises:

at least one screen disposed in a cross flow direction to a flow direction of said air flow;

said screen including a series of elongated slot openings having opposed planar side surfaces extending in the flow direction of said separated air flow; and said planar surfaces having a dimension in the flow direction of said separated air flow passing through said screen substantially greater than a dimension of said air passage and said cross flow direction to define deep narrow exit air passages facilitating an orderly flow of exit air through said screen without degradation of said textile fibers.

36. The apparatus of claim 35 wherein said screen includes a series of elongated finger bars spaced in said cross flow direction alternately laminated with adjustable spacer means disposed between said finger bars for providing a desired spacing between adjacent finger bars creating said slot openings; and said finger bars have opposed planar side surfaces extending in the flow direction of said separated air flow.

37. The apparatus of claim 36 wherein said adjustable spacer means includes spacer bars arranged between adjacent finger bars, and means for affixing an adjustable number of said spacer bars between said finger bars.

38. The apparatus of claim 37 wherein said finger bars terminate in free ends, and said spacer bars terminate short of said free ends of said finger bars to define said exit air passages.

39. The apparatus of claim 38 wherein said free ends of said finger bars are made to terminate on a common line and the distance from said common line to each respective terminal end of the alternately interposed spacer bars is made adjustable or variable thereby creating a plurality of variable length air exit passages disposed across said screen in a desired fashion to govern the cross-directional distribution of said opened fibers delivered at said fiber compacting means.

40. The apparatus of claim 38 wherein said spacer bars terminate in slanted ends to guide said separated air flow.

41. Apparatus for sorting textile fibers by length comprising:

fiber supply means for supplying said textile fibers;

fiber opening means receiving fibers from said fiber supply means for loosening and separating said fibers to produce opened fibers;

air propelling means creating an air flow for transporting said opened fibers; and cascaded fiber extraction means which includes a plurality of stationary fiber screening means at various stages in said air flow for progressively separating portions of said opened fibers from said air flow according to a length of said fibers so that said air flow contains progressively shorter opened fibers and separated opened fibers are retained at each of said stages.

42. The apparatus of claim 41 wherein said fiber extraction means includes a batt forming means disposed at each of said stages for forming a fiber batt from said separated opened fibers at each of said stages.

43. The apparatus of claim 41 wherein said cascaded fiber extracting means are in series.

44. The apparatus of claim 43 wherein said cascaded fiber extracting means are in parallel.

45. The apparatus of claim 41 wherein said cascaded fiber extracting means includes:

a first fiber extracting means having at least a first fiber separation screen for separating and retaining fibers having a length generally longer than a first fiber length;

a second fiber extracting means having at least a second fiber separation screen for separating fibers having a length generally longer than a second fiber length and shorter than said first fiber length; and at least a third fiber extracting means having at least a third fiber separation screen for separating fibers having a length generally longer than a third fiber length and shorter than said second fiber length.

46. The apparatus of claim 41 wherein each said fiber extraction means includes:

a plenum receiving said air flows; and a batt forming means disposed below said plenum means for forming a first fiber batt from said separated opened fibers from said respective air flows.

47. The apparatus of claim 46 including:

a pair of feed rolls included in each said batt forming means disposed below a fiber column containing compacted fibers forming a seal with said feed rolls so that fibers are not blown into a room in which said extracting means is located, and said feed rolls remove fibers from said fiber column to form said first fiber batt;

pressure monitoring means for sensing a function of pressure in said plenum means and generating a corresponding pressure signal;

drive means for rotatably driving said feed rolls; and control means responsive to said pressure monitoring means for controlling said drive means and hence the rotational speed of said feed rolls to maintain a desired level of said fibers in said fiber column and a desired corresponding pressure in said plenum means so that said seal is effectively maintained and said fibers are adequately compacted for formation into said compacted fiber batt.

48. The apparatus of claim 41 wherein each said fiber screening means comprises:

at least one screen disposed in a cross flow direction to a flow direction of said air flow;

said screen including a series of elongated slot openings having opposed planar side surfaces extending in the flow direction of a separated air flow; and said planar surfaces having a dimension in the flow direction of said separated air flow passing through said screen substantially greater than a dimension of said air passage and said cross flow direction to define deep narrow exit air passages facilitating an orderly flow of exit air through said screen without degradation of said textile fibers.

49. The apparatus of claim 48 wherein said screen includes a series of elongated finger bars spaced in said cross flow direction alternately laminated with adjustable spacer means disposed between said finger bars for providing a desired spacing between adjacent finger bars creating said slot openings; and said finger bars have opposed planar side surfaces extending in the flow direction of said separated air flow.

50. The apparatus of claim 49 wherein said adjustable spacer means includes spacer bars arranged between adjacent finger bars, and means for affixing an adjustable number of said spacer bars between said finger bars.

51. The apparatus of claim 50 wherein said finger bars terminate in free ends, and said spacer bars terminate short of said free ends of said finger bars to define said exit air passages.

52. The apparatus of claim 41 wherein said fiber screening means include fiber separation screens having progressively reduced velocity per unit square areas in a cascade arrangements.

53. Textile apparatus for forming a batt of textile fibers having a high degree of fiber separation, said apparatus comprising:

fiber supply means for supplying said textile fibers;

an air circulation loop;

fiber opening means receiving fibers from said fiber supply means for loosening and separating said fibers to produce opened fibers and for introducing said opened fibers to said air circulation loop;

air propelling means creating an air flow in a direction for transporting said opened fibers through said air propelling means and along said air circulation loop, said air propelling means being disposed in said air circulation loop downstream of said fiber opening means in the direction of said air flow;

fiber compacting means for forming a compacted batt of said opened fibers and discharging said compacted batt from said apparatus; and air separation means for separating substantially all of said opened fibers longer than about one-half inch in length from said air flow and thereafter preventing said separated fibers from recirculating around said air circulation loop, said air separation means being disposed in said air circulation loop downstream of said air propelling means in the direction of said air flow and near said fiber compacting means.

54. Textile apparatus for forming a batt of textile fibers having a high degree of fiber separation, said apparatus comprising:

fiber supply means for supplying said textile fibers;

an air circulation loop;

fiber opening means receiving fibers from said fiber supply means for loosening and separating said fibers to produce opened fibers and for introducing said opened fibers to said air circulation loop;

air propelling means creating an air flow in a direction for transporting said opened fibers through said air propelling means and along said air circulation loop, said air propelling means being disposed in said air circulation loop downstream of said fiber opening means in the direction of said air flow;

fiber compacting means for forming a compacted batt of said opened fibers and discharging said compacted batt from said apparatus; and air separation means for separating substantially all of said opened fibers longer than about one-half inch in length from said air flow and thereafter preventing said separated fibers from recirculating around said air circulation loop, said air separation means being disposed in said air circulation loop downstream of said air propelling means in the direction of said air flow and said air separation means operating in conjunction with said fiber compacting means.

55. A method of sorting textile fibers by length comprising:

feeding textile fibers to a fiber opening means;

opening said fibers in said fiber opening means to loosen and separate said fibers to produce opened fibers;

transporting said opened fibers in an air flow along an air flow path having different stages for progressively reducing the velocity of the air flow at each of said different stages;

progressively separating and removing shorter fibers from said air flow at different stages in said air flow path; and retaining said separated fibers at said different stages while transporting said shorter fibers to a next stage.

56. The method of claim 55 including filtering said air flow after said air flow has passed through a final stage of fiber separation.

57. The method of claim 55 including dividing said air flow into divided air flows having a reduced velocity at each of said stages.

58. The method of claim 57 wherein said stages are in series.

59. The method of claim 58 including passing said air flow through stages in parallel to said series stages.

60. The method of claim 55 including forming a compacted fiber batt from said separated fibers at each of said stages.

61. The method of claim 55 including passing said air flow through a series of fiber separation screens providing progressively reduced velocities at each of said stages.

* * * * *